US007399335B2

(12) United States Patent
Shekhter et al.

(10) Patent No.: US 7,399,335 B2
(45) Date of Patent: Jul. 15, 2008

(54) METHOD OF PREPARING PRIMARY REFRACTORY METAL

(75) Inventors: Leonid Natan Shekhter, Ashland, MA (US); Leah F. Simkins, Arlington, MA (US); Hugh P. Greville, Marblehead, MA (US); Leonid Lanin, Belmont, MA (US)

(73) Assignee: H.C. Starck Inc. (DE)

( * ) Notice: Subject to any disclaimer, the term of this patent is extended or adjusted under 35 U.S.C. 154(b) by 571 days.

(21) Appl. No.: 11/085,876

(22) Filed: Mar. 22, 2005

(65) Prior Publication Data

US 2006/0213327 A1 Sep. 28, 2006

(51) Int. Cl.
*B22F 9/22* (2006.01)

(52) U.S. Cl. ..... 75/346; 75/369

(58) Field of Classification Search ..... 75/346, 75/369

See application file for complete search history.

(56) References Cited

U.S. PATENT DOCUMENTS

| | | | | | |
|---|---|---|---|---|---|
| 1,728,941 | A | | 9/1929 | Marden et al. | |
| 2,516,863 | A | | 8/1950 | Gardner | 75/84 |
| 2,950,185 | A | | 8/1960 | Hellier et al. | 75/0.5 |
| 3,211,548 | A | | 10/1965 | Scheller et al. | 75/84 |
| 3,243,636 | A | | 3/1966 | Nineuil | 313/330 |
| 3,748,106 | A | | 7/1973 | Davis et al. | 29/192 |
| 3,974,245 | A | | 8/1976 | Cheney et al. | 264/10 |
| 3,989,511 | A | * | 11/1976 | Fey et al. | 75/346 |
| 4,149,998 | A | * | 4/1979 | Tauster et al. | 502/328 |
| 4,537,641 | A | | 8/1985 | Albrecht et al. | 148/11.5 P |
| 4,608,271 | A | | 8/1986 | Hieber et al. | 427/38 |
| 4,743,297 | A | | 5/1988 | Kopatz et al. | 75/0.5 B |
| 5,114,471 | A | | 5/1992 | Johnson et al. | 75/346 |
| 5,409,543 | A | | 4/1995 | Panitz et al. | 134/2 |
| 5,711,783 | A | | 1/1998 | Schloh | 75/362 |
| 5,972,065 | A | | 10/1999 | Dunn et al. | 75/10.19 |

(Continued)

FOREIGN PATENT DOCUMENTS

| | | |
|---|---|---|
| BE | 1013557 | 3/2002 |

(Continued)

OTHER PUBLICATIONS

Kirk-Othmer, Encyclopedia of Chemical Technology, 4th ed., vol. 23, (month unavailable) 1997, Terrance B. Tripp et al, pp. 658-679, "Tantalum and Tantalum Compounds".

(Continued)

*Primary Examiner*—George Wyszomierski
(74) *Attorney, Agent, or Firm*—Connolly Bove Lodge & Hutz LLP

(57) ABSTRACT

A method of preparing primary refractory metals (e.g., primary tantalum metal) by contacting a particulate refractory metal oxide (e.g., tantalum pentoxide) with a heated gas (e.g., a plasma), is described. The heated gas comprises hydrogen gas. The temperature range of the heated gas and the mass ratio of hydrogen gas to refractory metal oxide are each selected such that: (i) the heated gas comprises atomic hydrogen; (ii) the refractory metal oxide feed material is substantially thermodynamically stabilized (i.e., the concurrent formation of suboxides that are not reduced by atomic hydrogen is minimized); and (iii) the refractory metal oxide is reduced by contact with the heated gas, thereby forming primary refractory metal (e.g., primary tantalum metal and/or primary niobium metal).

22 Claims, 14 Drawing Sheets

U.S. PATENT DOCUMENTS

| | | | | |
|---|---|---|---|---|
| 6,139,922 | A | 10/2000 | Kaloyeros et al. | 427/576 |
| 6,171,363 | B1 | 1/2001 | Shekhter et al. | 75/369 |
| 6,197,082 | B1 | 3/2001 | Dorvel et al. | 75/10.13 |
| 6,226,173 | B1 * | 5/2001 | Welsch et al. | 361/508 |
| 6,558,447 | B1 | 5/2003 | Shekhter et al. | 75/252 |
| 6,689,187 | B2 | 2/2004 | Oda | 75/255 |
| 7,341,705 | B2 * | 3/2008 | Schnitter | 423/594.17 |
| 2002/0050185 | A1 | 5/2002 | Oda | 75/255 |
| 2004/0163491 | A1 | 8/2004 | Shekhter et al. | 75/245 |

FOREIGN PATENT DOCUMENTS

| | | | |
|---|---|---|---|
| CA | 2 532 128 | | 1/2005 |
| EP | 0 339 914 | A1 | 11/1989 |
| EP | 1 066 899 | A2 | 1/2001 |
| EP | 1 227 508 | A1 | 7/2002 |
| WO | 2004/042095 | A1 | 5/2004 |

OTHER PUBLICATIONS

H. Hiebler, J.F. Plaul: "Hydrogen plasma smelting reduction—an option for steelmaking in the future" Metallurgija, vol. 43, No. 3, 2004, pp. 155-162, XP001246865.

Luidold S et al: "Processes for Niobium Powder—A Literature Evaluation Part I: Reduction of Niobium Compounds Prozesse Fuer Niobpulver—Eine Literaturauswertung. Teil I: Reduktion Von Niobverbindungen Procede Pour LA Production De Niobium En Poudre—Une Evaluation D" World Of Metallurgy—Erzmetall, GDMB-Medienverlag, Clausthal-Zellerfeld, DE, vol. 58, No. 2, Mar. 2005, pp. 89-94, XP001225823.

Y.-W. Zhang. W.-Z. Ding, X.-G. Lu: "Reduction of Ti02 with hydrogen cold plasma in DC pulsed glow discharge" Trans. Nonferrous Met. Soc. China, vol. 15, No. 3, 2005, pp. 594-599 XP009068386.

* cited by examiner $[H_{2(g)} : Ta_2O_5] = [0.1 : 1.0]$

| T, K | mas fract. |
|---|---|
| 2100 | 0.0099 |
| 2200 | 0.01388 |
| 2300 | 0.01828 |
| 2400 | 0.02339 |
| 2500 | 0.02913 |
| 2600 | 0.0353 |
| 2700 | 0.04139 |
| 2800 | 0.04644 |
| 2900 | 0.0485 |
| 3000 | 0.04389 |
| 3100 | 0.02569 |
| 3200 | 0 |

p=0.1 MPa $[H_{2(g)} : Ta_2O_5] = [0.25 : 1.0]$

| T, K | mas fract. |
|---|---|
| 2100 | 0.0198 |
| 2200 | 0.02777 |
| 2300 | 0.03655 |
| 2400 | 0.04677 |
| 2500 | 0.05827 |
| 2600 | 0.07059 |
| 2700 | 0.08279 |
| 2800 | 0.09288 |
| 2900 | 0.097 |
| 3000 | 0.08777 |
| 3100 | 0.05138 |
| 3200 | 0 |

$[H_{2(g)} : Ta_2O_5] = [0.4 : 1.0]$

| T, K | mas.fract. |
|---|---|
| 2100 | 0.0297 |
| 2200 | 0.04165 |
| 2300 | 0.05483 |
| 2400 | 0.07016 |
| 2500 | 0.0874 |
| 2600 | 0.10589 |
| 2700 | 0.12418 |
| 2800 | 0.13932 |
| 2900 | 0.1455 |
| 3000 | 0.13166 |
| 3100 | 0.08021 |
| 3200 | 0.01662 |

$[H_{2(g)} : Ta_2O_5] = [0.7 : 1.0]$

| T, K | mas.fract. |
|---|---|
| 2100 | 0.0396 |
| 2200 | 0.05553 |
| 2300 | 0.0731 |
| 2400 | 0.09355 |
| 2500 | 0.11653 |
| 2600 | 0.14118 |
| 2700 | 0.16557 |
| 2800 | 0.18576 |
| 2900 | 0.194 |
| 3000 | 0.16389 |
| 3100 | 0.1024 |
| 3200 | 0.03945 |

p=0.1 MPa $[H_{2(g)} : Ta_2O_5] = [1.0 : 1.0]$

| T, K | mas.fract. |
|---|---|
| 2100 | 0.0495 |
| 2200 | 0.06941 |
| 2300 | 0.09138 |
| 2400 | 0.11693 |
| 2500 | 0.14566 |
| 2600 | 0.17648 |
| 2700 | 0.20696 |
| 2800 | 0.2322 |
| 2900 | 0.22017 |
| 3000 | 0.16774 |
| 3100 | 0.11199 |
| 3200 | 0.05311 |

$[H_{2(g)} : Ta_2O_5] = [1.5 : 1.0]$

| T, K | mas.fract. |
|---|---|
| 2100 | 0.0594 |
| 2200 | 0.0833 |
| 2300 | 0.10966 |
| 2400 | 0.14032 |
| 2500 | 0.1748 |
| 2600 | 0.21177 |
| 2700 | 0.24836 |
| 2800 | 0.23739 |
| 2900 | 0.20081 |
| 3000 | 0.15835 |
| 3100 | 0.11087 |
| 3200 | 0.05869 |

$[H_{2(g)} : Ta_2O_5] = [2.3 : 1.0]$

| T, K | mas.fract. |
|---|---|
| 2100 | 0.0693 |
| 2200 | 0.09718 |
| 2300 | 0.12793 |
| 2400 | 0.16371 |
| 2500 | 0.20393 |
| 2600 | 0.22572 |
| 2700 | 0.2124 |
| 2800 | 0.19344 |
| 2900 | 0.16831 |
| 3000 | 0.13696 |
| 3100 | 0.09974 |
| 3200 | 0.05719 |

$[H_{2(g)} : Ta_2O_5] = [4.0 : 1.0]$

| T, K | mas fract. |
|---|---|
| 2100 | 0.0792 |
| 2200 | 0.1106 |
| 2300 | 0.14621 |
| 2400 | 0.16134 |
| 2500 | 0.15904 |
| 2600 | 0.15506 |
| 2700 | 0.14851 |
| 2800 | 0.13841 |
| 2900 | 0.12378 |
| 3000 | 0.1039 |
| 3100 | 0.07848 |
| 3200 | 0.04774 |

$[H_{2(g)} : Ta_2O_5] = [9.0 : 1.0]$

| T, K | mas.fract. |
|---|---|
| 2100 | 0.08184 |
| 2200 | 0.08177 |
| 2300 | 0.0816 |
| 2400 | 0.08128 |
| 2500 | 0.08063 |
| 2600 | 0.07944 |
| 2700 | 0.07729 |
| 2800 | 0.07362 |
| 2900 | 0.0677 |
| 3000 | 0.05871 |
| 3100 | 0.04602 |
| 3200 | 0.02943 |

$[H_{2(g)} : Nb_2O_5] = [2.3 : 1.0]$

Nb(c)

| T, K | mas.fract. |
|---|---|
| 2000 | 0 |
| 2100 | 0 |
| 2200 | 0 |
| 2300 | 0 |
| 2400 | 0.05782 |
| 2500 | 0.14292 |
| 2600 | 0.15405 |
| 2700 | 0.12895 |
| 2800 | 0.09993 |
| 2900 | 0.06759 |
| 3000 | 0.03064 |
| 3100 | $0.1270 \cdot 10^{-19}$ |

p=0.1 MPa $[H_{2(g)} : Nb_2O_5] = [4.0 : 1.0]$

Nb(c)

| T, K | mas.fract. |
|---|---|
| 2000 | 0 |
| 2100 | 0 |
| 2200 | 0.06169 |
| 2300 | 0.13471 |
| 2400 | 0.13031 |
| 2500 | 0.12318 |
| 2600 | 0.1124 |
| 2700 | 0.09719 |
| 2800 | 0.07796 |
| 2900 | 0.05503 |
| 3000 | 0.02763 |
| 3100 | $0.5699 \cdot 10^{-19}$ |

p=0.1 MPa $[H_{2(g)} : Nb_2O_5] = [9.0 : 1.0]$

Nb(c)

| T, K | mas.fract. |
|---|---|
| 2000 | 0.03539 |
| 2100 | 0.06962 |
| 2200 | 0.06928 |
| 2300 | 0.06859 |
| 2400 | 0.06729 |
| 2500 | 0.06494 |
| 2600 | 0.06094 |
| 2700 | 0.05452 |
| 2800 | 0.04536 |
| 2900 | 0.03332 |
| 3000 | 0.01795 |
| 3100 | $0.9190 \cdot 10^{-10}$ |

p=0.1 MPa $[H_{2(g)} : NbO_2] = [9.0 : 1.0]$

| T, K | mas.fract. |
|---|---|
| 1900 | 0.01464 |
| 2000 | 0.06586 |
| 2100 | 0.07417 |
| 2200 | 0.07391 |
| 2300 | 0.07339 |
| 2400 | 0.07238 |
| 2500 | 0.07053 |
| 2600 | 0.0673 |
| 2700 | 0.062 |
| 2800 | 0.05429 |
| 2900 | 0.04398 |
| 3000 | 0.03065 |

METHOD OF PREPARING PRIMARY REFRACTORY METAL

FIELD OF THE INVENTION

The present invention relates to a method of preparing primary refractory metal by reducing refractory metal oxide (e.g., tantalum pentoxide) in a heated gas (e.g., a plasma) containing a reactive gas comprising hydrogen. The temperature range of the heated gas and the weight ratio of hydrogen gas to refractory metal oxide are each selected such that the heated gas comprises atomic hydrogen, the refractory metal oxide feed material is substantially thermodynamically stabilized, and the refractory metal oxide is reduced by contact with the heated gas, thereby forming primary refractory metal (e.g., primary tantalum metal).

BACKGROUND OF THE INVENTION

Certain refractory metals, such as tantalum and niobium, can be difficult to isolate in their pure (or primary) form due in part to the thermodynamic stability of precursors thereof, such as oxides. The production of primary refractory metals is desirable because they are used in such applications as raw materials from which capacitor anodes may be prepared. Existing methods of forming primary refractory metals typically involve multi-stage processes in which a refractory metal oxide (e.g., tantalum pentoxide or niobium pentoxide) or other precursor (e.g., tantalum halides) is reduced through one or more steps followed by further refining and purification steps. Such multistage processes typically result in the formation of co-product waste streams.

Raw materials from which tantalum metal may be produced include, for example, heptafluorotantalate ($K_2TaF_7$), tantalum halides and tantalum pentoxide. The reduction of potassium heptafluorotantalate with sodium is a known older method of producing tantalum metal. Potassium heptafluorotantalate and small pieces of sodium are sealed in a metal tube, and heated to an ignition temperature which results in the formation of a solid mass that includes tantalum metal, potassium heptafluorotantalate, sodium and other co-products. The solid mixture is then crushed and leached with dilute acid to isolate the tantalum metal, which is typically less than pure.

Tantalum metal may also be formed by a further method in which a molten composition of potassium heptafluorotantalate is reduced in the presence of a diluent salt (e.g., sodium chloride) by the introduction of molten sodium metal into the reactor, under conditions of constant stirring. The molten sodium reduction process results in the formation of a solid mass containing tantalum metal, sodium fluoride, potassium fluoride and other co-products. The solid mass is crushed and leached with a dilute acid solution, to isolate the tantalum metal. Typically, additional process steps, such as agglomeration, must be performed on the product tantalum metal for purposes of improving physical properties. See, for example, U.S. Pat. No. 2,950,185.

The electrolytic production of tantalum involves electrolyzing a molten mixture of potassium heptafluorotantalate containing tantalum pentoxide ($Ta_2O_5$) at about 700° C. in a metal container. The electrolytic reduction results in the formation of a solid mass containing tantalum metal, potassium heptafluorotantalate, tantalum oxides and other co-products. The solid mass is then crushed and leached with dilute acid to isolate the tantalum metal, which is typically less than pure. Such electrolytic methods of producing tantalum metal typically are not presently used on a manufacturing scale.

Other methods of producing refractory metals, such as tantalum metal, include the reduction of tantalum pentoxide with calcium metal in the presence of calcium chloride as described in, for example, U.S. Pat. No. 1,728,941; and the reduction of tantalum pentoxide in the presence of a silicide, such as magnesium silicide and a hydride, such as calcium hydride, as described in, for example, U.S. Pat. No. 2,516,863. Such other methods involve multiple stages and result in the formation of co-products from which the refractory metal must be separated.

A more recent method of producing refractory metals, such at tantalum metal, involves less than completely reducing a refractory metal oxide (e.g., tantalum pentoxide or niobium pentoxide) by contacting the refractory metal oxide with a gaseous reducing agent, such as gaseous magnesium. The less than completely reduced refractory metal is then leached, further reduced and agglomerated. See for example, U.S. Pat. No. 6,171,363 B1.

Another recent method of producing refractory metals, such as tantalum and niobium, involves first passing hydrogen gas through powder refractory metal oxide (e.g., tantalum pentoxide) thereby producing an intermediate refractory metal suboxide (e.g., tantalum mono-oxide). In the second stage, the refractory metal suboxide is reduced by contact with a gaseous reducing agent (e.g., gaseous magnesium). The nearly fully reduced refractory metal is then leached, further reduced and agglomerated. See for example, U.S. Pat. No. 6,558,447 B1.

Still further methods of preparing refractory metals involve introducing a refractory metal halide (e.g., tantalum pentachloride) or a refractory metal alkoxide (e.g., tantalum alkoxide) into a plasma formed from hydrogen gas. Such plasma methods result in the formation of undesirable co-products, such as corrosive gaseous hydrogen halides (e.g., gaseous hydrogen chloride), and gaseous alkanols. Refractory metal halide plasma methods are described in further detail in, for example, U.S. Pat. Nos. 3,211,548; 3,748,106; and 6,689,187 B2. Refractory metal alkoxide plasma methods are described in further detail in, for example, U.S. Pat. No. 5,711,783.

U.S. Pat. No. 5,972,065 discloses purifying tantalum by means of plasma arc melting. In the method of the '065 patent, powdered tantalum metal is placed in a vessel, and a flowing plasma stream formed from hydrogen and helium is passed over the powdered tantalum metal.

European Patent Application No. EP 1 066 899 A2 discloses a method of preparing high purity spherical particles of metals such as tantalum and niobium. The method disclosed in the '899 application involves introducing tantalum powder into a plasma formed from hydrogen gas. The temperature of the plasma is disclosed as being between 5000 K and 10,000 K in the '899 application.

It would be desirable to develop methods of preparing substantially pure refractory metals, such as primary refractory metals, that do not involve multiple process steps, and preferably involve only a single reduction step. It would also be desirable that such newly developed methods of refractory metal preparation: make use of feed stocks that are readily available and comparatively safe to handle; and at least minimize the formation of undesirable co-products that must be separated and/or otherwise further processed.

SUMMARY OF THE INVENTION

In accordance with the present invention, there is provided a method of preparing a primary refractory metal that can be achieved in substantially a single step and results in the formation of a co-product comprising substantially water, which method involves:

(a) heating a gas comprising a reactive gas, said reactive gas comprising hydrogen gas, thereby forming a heated gas having a temperature range; and (b) contacting a particulate refractory metal oxide with said heated gas, wherein, (i) said temperature range of said heated gas, and (ii) a weight ratio of the hydrogen gas of said heated gas to said particulate refractory metal oxide, are each selected such that, said heated gas comprises atomic hydrogen, said refractory metal oxide is substantially thermodynamically stabilized, and said refractory metal oxide is reduced by atomic hydrogen in step (b), thereby forming said primary refractory metal.

In accordance with the present invention, there is also provided a method of preparing primary tantalum metal comprising:

(a) heating a gas comprising a reactive gas, said reactive gas comprising hydrogen gas, thereby forming a heated gas; and (b) contacting particulate tantalum pentoxide with said heated gas at a temperature of 1900 K (degrees Kelvin) to 2900 K, thereby reducing said particulate tantalum pentoxide and forming primary tantalum metal;

wherein the hydrogen gas of said heated gas and said particulate tantalum pentoxide contacted with said heated gas have a mass ratio of hydrogen gas to particulate tantalum pentoxide of greater than 1.5:1.

In accordance with the present invention, there is further provided a method of preparing primary niobium metal comprising:

(a) heating a gas comprising a reactive gas, said reactive gas comprising hydrogen gas, thereby forming a heated gas; and (b) contacting a particulate oxide of niobium selected from the group consisting of niobium dioxide, niobium pentoxide and combinations thereof, with said heated gas at a temperature of 2100K to 2700° K, thereby reducing said particulate oxide of niobium and forming primary niobium metal;

wherein the hydrogen gas of said heated gas and said particulate oxide of niobium contacted with said heated gas have a mass ratio of hydrogen gas to particulate oxide of niobium of at least 9:1.

The features that characterize the present invention are pointed out with particularity in the claims, which are annexed to and form a part of this disclosure. These and other features of the invention, its operating advantages and the specific objects obtained by its use will be more fully understood from the following detailed description and accompanying drawings.

Unless otherwise indicated, all numbers or expressions, such as those expressing structural dimensions, compositional amounts, process conditions, etc. used in the specification and claims are understood as modified in all instances by the term "about."

BRIEF DESCRIPTION OF THE DRAWINGS

In FIGS. 1 through 14, like reference numerals and characters designate the same components and features.

DETAILED DESCRIPTION OF THE INVENTION

Figure 1:
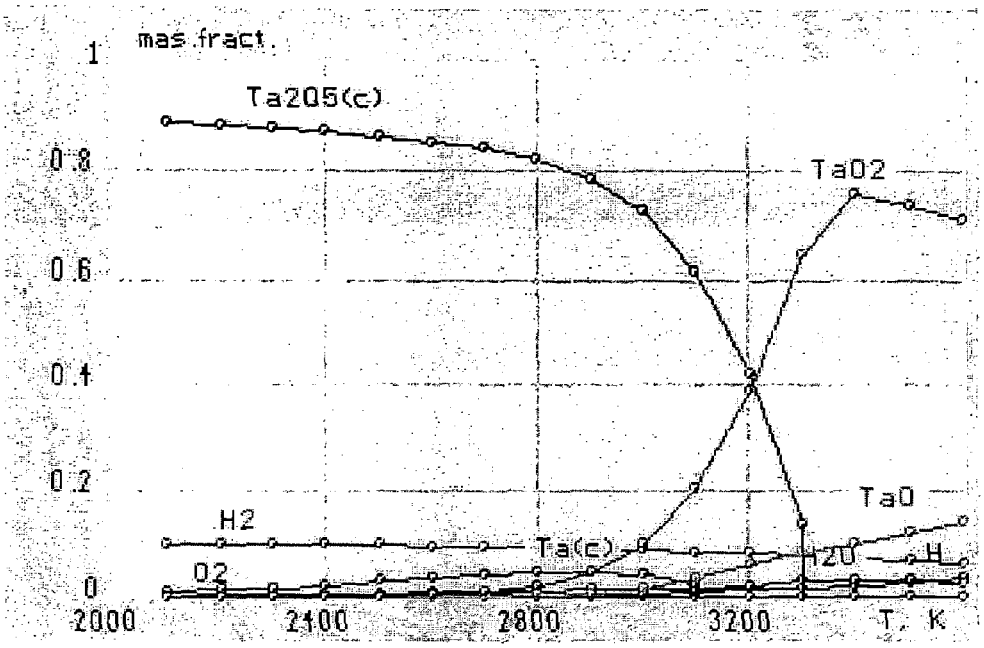
FIG. 1 is a graphical representation of a plot of mass fraction as a function of temperature, for the formation of primary tantalum metal, at a mass ratio of hydrogen gas to tantalum pentoxide of 0.1:1.0, FIG. 1 also includes a tabulation of the mass fraction of condensed primary tantalum metal ($Ta_{(c)}$) as a function of temperature, from which a portion of the graph is drawn.
Figure 2:
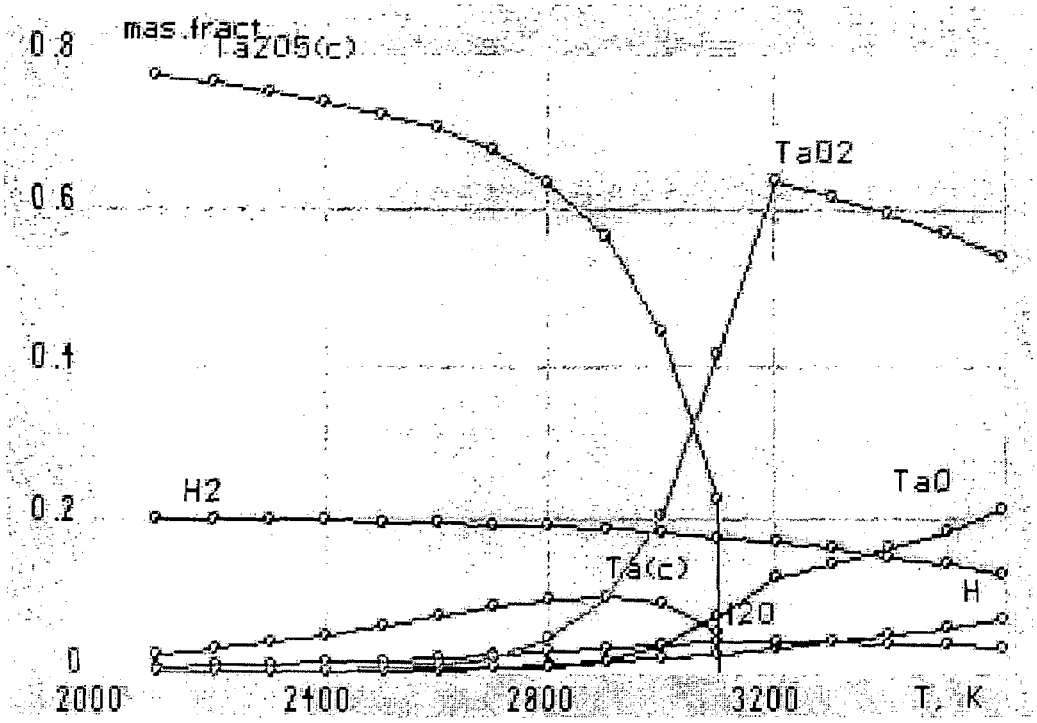
FIG. 2 is a graphical representation of a plot of mass fraction as a function of temperature, for the formation of primary tantalum metal, at a mass ratio of hydrogen gas to tantalum pentoxide of 0.25:1.0, FIG. 2 also includes a tabulation of the mass fraction of condensed primary tantalum metal ($Ta_{(c)}$) as a function of temperature, from which a portion of the graph is drawn.
Figure 3:
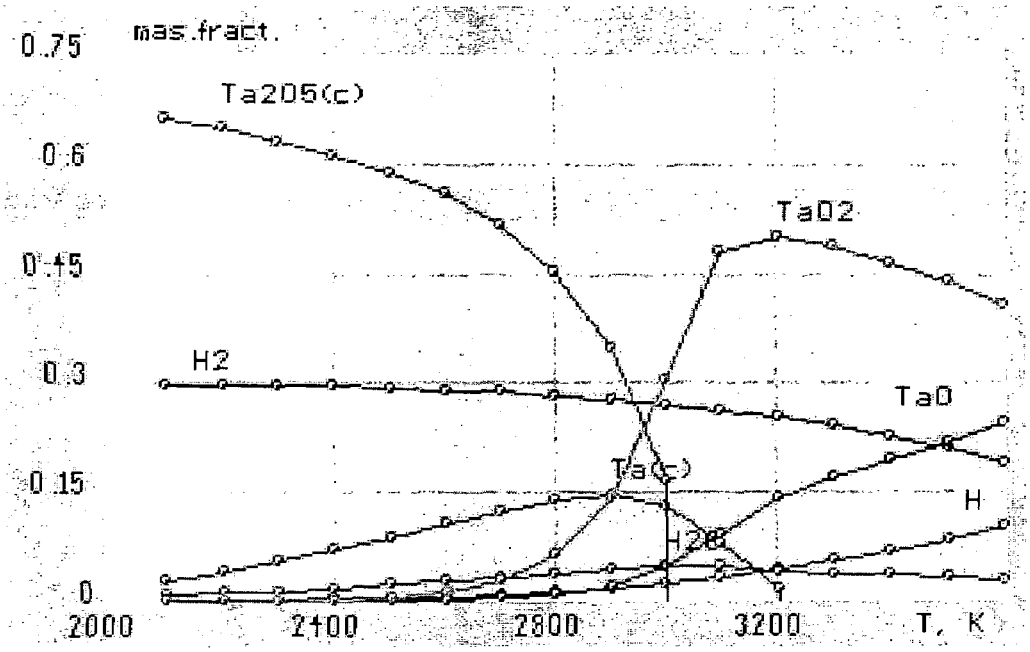
FIG. 3 is a graphical representation of a plot of mass fraction as a function of temperature, for the formation of primary tantalum metal, at a mass ratio of hydrogen gas to tantalum pentoxide of 0.4:1.0, FIG. 3 also includes a tabulation of the mass fraction of condensed primary tantalum metal ($Ta_{(c)}$) as a function of temperature, from which a portion of the graph is drawn.
Figure 4:
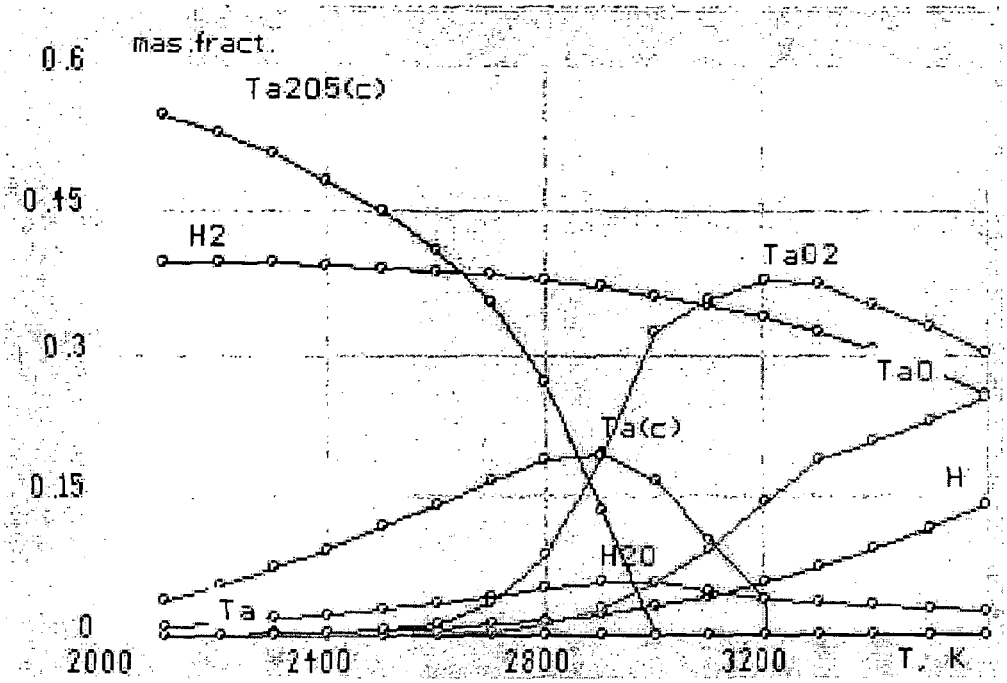
FIG. 4 is a graphical representation of a plot of mass fraction as a function of temperature, for the formation of primary tantalum metal, at a mass ratio of hydrogen gas to tantalum pentoxide of 0.7:1.0, FIG. 4 also includes a tabulation of the mass fraction of condensed primary tantalum metal ($Ta_{(c)}$) as a function of temperature, from which a portion of the graph is drawn.
Figure 5:
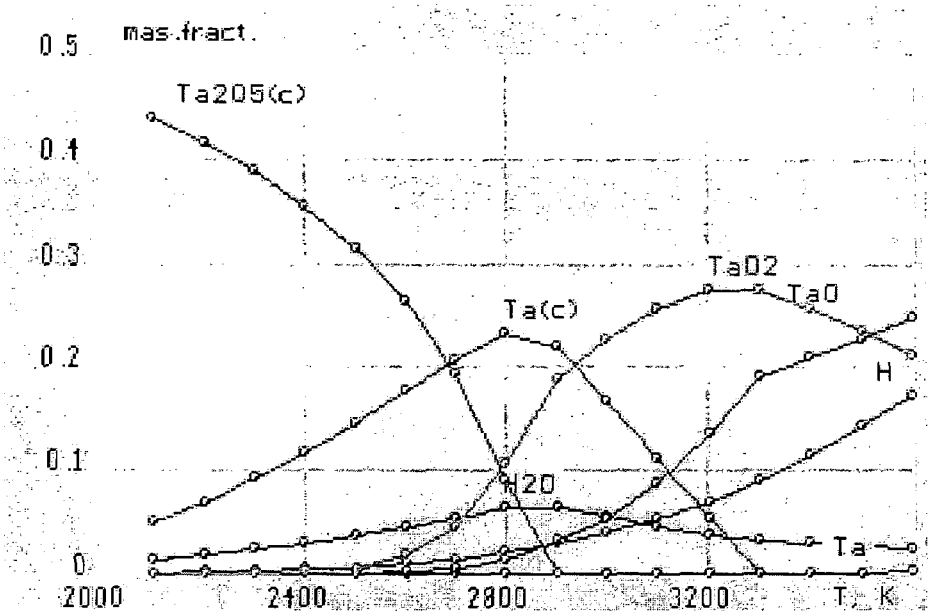
FIG. 5 is a graphical representation of a plot of mass fraction as a function of temperature, for the formation of primary tantalum metal, at a mass ratio of hydrogen gas to tantalum pentoxide of 1.0:1.0, FIG. 5 also includes a tabulation of the mass fraction of condensed primary tantalum metal ($Ta_{(c)}$) as a function of temperature, from which a portion of the graph is drawn.

As used herein and in the claims, the term "atomic hydrogen" means gaseous mono-atomic hydrogen (i.e., $H_{(g)}$ or H) that is not in an ionic form (e.g., gaseous hydrogen cation, $H^{+}_{(g)}$ or $H^{+}$). As used herein, the term "hydrogen gas" means gaseous molecular (diatomic) hydrogen (i.e., $H_{2(g)}$ or $H_2$).

The gas, that is heated and contacted with the refractory metal oxide feed material in the method of the present invention, comprises a reactive gas which comprises hydrogen gas. Optionally the reactive gas may further comprise other reactive components, such as alkanes (e.g., methane, ethane, propane, butane and combinations thereof). If the reactive gas includes reactive components other than hydrogen (e.g., methane), such other reactive components are typically present in a minor amount (e.g., in amounts less than or equal to 49 percent by weight, based on the total weight of reactive gas). The reactive gas may include: hydrogen in an amount of from 51 to 99 percent by weight, 60 to 85 percent by weight, or 70 to 80 percent by weight; and a reactive component other than hydrogen (e.g., methane) in an amount of 1 to 49 percent by weight, 15 to 40 percent by weight, or 20 to 30 percent by weight, the percent weights being based on the total weight of the reactive gas. Preferably, the reactive gas comprises substantially 100 percent by weight of hydrogen gas.

The gas, that is heated and contacted with the refractory metal oxide feed material in the method of the present invention, may optionally further include an inert gas. The inert gas may be selected from, for example, one or more group VIII noble gasses of the periodic table of the elements. Group VIII elements from which the inert gas may be selected include neon, argon, krypton, xenon and combinations thereof. A preferred inert gas is argon. If an inert gas is present, the gas (feed gas) that is heated and contacted with the refractory metal oxide typically includes: from 20 to 50 percent by weight of reactive gas, or 25 to 40 percent by weight of reactive gas; and from 50 to 80 percent by weight of inert gas, or from 60 to 75 percent by weight of inert gas, the percent weights being based on the total weight of the feed gas. The inert gas is typically used as a carrier for the reactive gas. When the method of the present invention is conducted by plasma means, the gas (feed gas) typically includes an inert gas, such as argon, as will be discussed in further detail herein.

The method of the present invention includes the selection of both the temperature range of the heated gas, and a weight ratio of hydrogen gas to the particulate refractory metal oxide feed material, that is contacted with the heated gas. These parameters are selected such that: the heated gas comprises atomic hydrogen; the refractory metal oxide feed material is substantially thermodynamically stabilized; and the refractory metal oxide feed material is reduced by atomic hydrogen. Preferably, the refractory metal oxide feed material is substantially completely reduced by atomic hydrogen during contact with the heated gas.

The selection of the temperature range of the heated gas, and the weight ratio of hydrogen gas to particulate refractory metal oxide is not a trivial endeavor, and has heretofore not been recognized. For purposes of demonstration, the formation of primary tantalum metal by means of the reduction of tantalum pentoxide with atomic hydrogen will be discussed as follows. Tantalum metal has a melting point of approximately 3000° C. As such, heated gas temperatures below and somewhat above the melting point of tantalum are of interest, for purposes of minimizing energy costs, and depending on whether the formation of molten tantalum metal is desired.

The formation of primary tantalum metal by means of the reduction of tantalum pentoxide with molecular hydrogen (i.e., $H_{2(g)}$), is not thermodynamically favorable over a temperature range of 1000° C. to 3600° C. The following general reaction equation (I) is representative of the reduction of tantalum pentoxide by molecular hydrogen, $$Ta_2O_5 + 5H_{2(g)} \rightleftharpoons 2Ta + 5H_2O(g) \quad \text{(I)}$$

General reaction equation (I) was analyzed thermodynamically by means of a Gibbs energy minimization analysis method using a computer program available commercially from Outokumpu Research Oy, of Finland, under the name HSC Chemistry 5.1.

For purposes of general reference, if the standard Gibbs free energy values (i.e., ΔG values) are negative, the reaction of equation (I) is deemed to be favorable and accordingly the equilibrium thereof is shifted to the right of the is equation, and the related equilibrium constant is greater than 1.0. Correspondingly, if the standard Gibbs free energy values are positive, the reaction is deemed to be less favorable or unfavorable (depending on the magnitude of the positive value) and accordingly the equilibrium thereof is shifted to the left of the equation, and the related equilibrium constant is less than 1.0. A standard Gibbs free energy value of zero corresponds to an equilibrium constant of 1.0.

Standard Gibbs free energy values are calculated using the following general equation.

$$\Delta G = -(R) \times (T) \times Ln(K)$$

In the above equation: the symbol "R" represents the gas constant; "T" represents temperature in degrees Kelvin; and "K" is the equilibrium constant.

More particularly, the results of a Gibbs energy minimization computer analysis of reaction equation (I) using the HSC Chemistry 5.1 software are summarized in the following Table 1.

TABLE 1

| T (° C.) | ΔH (Kcal) | ΔS (cal/K) | ΔG (kcal) | K | Log (K) |
|---|---|---|---|---|---|
| 1000 | 183.192 | 30.237 | 144.695 | 1.44E−25 | −24.841 |
| 1200 | 180.121 | 27.995 | 138.88 | 2.48E−21 | −20.605 |
| 1400 | 177.272 | 26.18 | 133.469 | 3.67E−18 | −17.435 |
| 1600 | 174.665 | 24.707 | 128.385 | 1.05E−15 | −14.981 |
| 1800 | 143.425 | 9.475 | 123.782 | 8.91E−14 | −13.05 |
| 2000 | 139.131 | 7.497 | 122.089 | 1.82E−12 | −11.739 |
| 2200 | 135.046 | 5.774 | 120.766 | 2.12E−11 | −10.673 |
| 2400 | 131.152 | 4.259 | 119.766 | 1.61E−10 | −9.793 |
| 2600 | 127.476 | 2.933 | 119.049 | 8.78E−10 | −9.056 |
| 2800 | 124.071 | 1.787 | 118.58 | 3.68E−09 | −8.434 |
| 3000 | 121.117 | 0.854 | 118.321 | 1.26E−08 | −7.901 |
| 3200 | 132.27 | 4.279 | 117.409 | 4.09E−08 | −7.389 |
| 3400 | 128.231 | 3.148 | 116.668 | 1.14E−07 | −6.942 |
| 3600 | 124.225 | 2.086 | 116.146 | 2.79E−07 | −6.554 |

The results summarized in Table 1 indicate that the reduction of tantalum pentoxide by molecular hydrogen and the formation primary tantalum metal, as represented by general reaction equation (I), is not thermodynamically favorable over a temperature range of 1000° C. to 3600° C. In particular, it should be noted that the ΔG values of Table 1 are positive and of large magnitude (in excess of 100 Kcal) over the evaluated temperature range (i.e., the equilibrium of reaction equation (I) is shifted towards the left/feed side and away from the right/product side thereof). As such, the reduction of tantalum pentoxide is not feasible over a temperature range of 1000° C. to 3600° C.

The symbols in Table 1, and the following tables, have the following meanings: T represents temperature; H represents enthalpy; S represents entropy; ΔG represents standard Gibbs free energy; and K represents the equilibrium constant of the related reaction equation.

Reduction of tantalum pentoxide by atomic hydrogen is represented by the following representative reaction equation (II), $$Ta_2O_5 + 10H_{(g)} \rightleftharpoons 2Ta + 5H_2O(g) \quad \text{(II)}$$

Results of a Gibbs energy minimization computer analysis of reaction equation (II), using the HSC Chemistry 5.1 software, are summarized in the following Table 2.

TABLE 2

| T (° C.) | ΔH (Kcal) | ΔS (cal/K) | ΔG (kcal) | K | Log (K) |
|---|---|---|---|---|---|
| 1000 | −351.548 | −108.756 | −213.086 | 3.82E+36 | 36.581 |
| 1200 | −356.938 | −112.691 | −190.927 | 2.13E+28 | 28.327 |
| 1400 | −361.932 | −115.873 | −168.059 | 9.00E+21 | 21.954 |
| 1600 | −366.515 | −118.462 | −144.617 | 7.49E+16 | 16.875 |
| 1800 | −399.569 | −134.615 | −120.492 | 5.05E+12 | 12.703 |
| 2000 | −405.521 | −137.357 | −93.288 | 9.33E+08 | 8.97 |
| 2200 | −411.115 | −139.717 | −65.575 | 6.24E+05 | 5.795 |
| 2400 | −416.376 | −141.763 | −37.422 | 1.15E+03 | 3.06 |
| 2600 | −421.282 | −143.534 | −8.888 | 4.74E+00 | 0.676 |
| 2800 | −425.79 | −145.051 | 19.975 | 3.80E−02 | −1.421 |
| 3000 | −429.726 | −146.293 | 49.114 | 5.25E−04 | −3.28 |
| 3200 | −419.439 | −143.126 | 77.659 | 1.30E−05 | −4.887 |
| 3400 | −424.237 | −144.469 | 106.42 | 4.65E−07 | −6.332 |
| 3600 | −428.902 | −145.706 | 135.44 | 2.28E−08 | −7.643 |

The results summarized in Table 2 indicate that the formation of primary tantalum metal by means of the reduction of tantalum pentoxide with atomic hydrogen is thermodynamically feasible at a temperatures of less than or equal to about 3000° C., and more favorable at temperatures of less than or equal to 2800° C. Over the temperature range of 1000° C. to 2600° C., ΔG values of Table 2 are negative, thus indicating a shift in the equilibrium constant of reaction equation (II) to the right/product side of the equation (i.e., towards the formation of primary tantalum metal). At temperatures of 2800° C. and 3000° C., the standard Gibbs free energy values, while positive, are of sufficiently small magnitude that tantalum is formed. Overall, the results of Table 2 taken by themselves, indicate that the reduction of tantalum pentoxide by atomic hydrogen is more favorable and should be conducted at temperatures of less than or equal to 2600° C.

However, the formation of ionic hydrogen (which is capable of reducing tantalum pentoxide) over a temperature range of 1000° C. to 3000° C., is not thermodynamically feasible. In addition, the formation of atomic hydrogen, while feasible at temperatures of greater than or equal to 2000° C., only becomes favorable at temperatures of greater than or equal to 3000° C., as will be discussed in further detail herein.

The formation of atomic hydrogen is represented by the following general reaction equation (III), $$H_{2(g)} \rightleftharpoons 2H_{(g)} \quad \text{(III)}$$

The general reaction represented by general equation (III) underwent a Gibbs energy minimization computer analysis, using the HSC Chemistry 5.1 software, the results of which are summarized in the following Table 3.

TABLE 3

| T (° C.) | ΔH (kcal) | ΔS (cal/K) | ΔG (kcal) | K | Log(K) |
|---|---|---|---|---|---|
| 1000 | 106.948 | 27.799 | 71.556 | 5.20E−13 | −12.284 |
| 1200 | 107.412 | 28.137 | 65.961 | 1.64E−10 | −9.787 |
| 1400 | 107.841 | 28.411 | 60.306 | 1.33E−08 | −7.878 |
| 1600 | 108.236 | 28.634 | 54.601 | 4.26E−07 | −6.371 |
| 1800 | 108.599 | 28.818 | 48.855 | 7.07E−06 | −5.151 |
| 2000 | 108.93 | 28.971 | 43.075 | 7.22E−05 | −4.142 |
| 2200 | 109.232 | 29.098 | 37.268 | 5.09E−04 | −3.294 |
| 2400 | 109.505 | 29.204 | 31.438 | 2.69E−03 | −2.57 |
| 2600 | 109.752 | 29.293 | 25.587 | 1.13E−02 | −1.947 |
| 2800 | 109.972 | 29.368 | 19.721 | 3.96E−02 | −1.403 |
| 3000 | 110.168 | 29.43 | 13.841 | 1.19E−01 | −0.924 |
| 3200 | 110.342 | 29.481 | 7.95 | 3.16E−01 | −0.5 |
| 3400 | 110.494 | 29.523 | 2.049 | 7.55E−01 | −0.122 |
| 3600 | 110.625 | 29.558 | −3.859 | 1.65E+00 | 0.218 |

From the summary of data in Table 3 it can be seen that the standard Gibbs free energy for the formation of atomic hydrogen is positive over the entire temperature range of 1000° C. to 3400° C., and becomes negative at a temperature of 3600° C. The equilibrium constant (K) for general reaction equation (III), is represented by the following equation.

$$K=(P_{H(g)})^2/(P_{H2(g)})$$

The symbol "$P_{H(g)}$" refers to the partial pressure for atomic hydrogen, and the symbol "$P_{H2(g)}$" refers to the partial pressure of molecular hydrogen. Presuming a volume percent of hydrogen gas of 100 percent by volume and a partial pressure of hydrogen gas of 1 atm, an estimate of the volume percent of atomic hydrogen can be determined from a square root of the equilibrium constant at a particular temperature. For example at a temperature of 2000° C., the percent volume of atomic hydrogen is about 1 percent, while the volume percent of molecular hydrogen is accordingly about 99 percent. At a temperature of 2200° C., the percent volume of atomic hydrogen is about 2 percent, while the volume percent of molecular hydrogen is accordingly about 98 percent.

At a temperature of 2400° C., the percent volume of atomic hydrogen is about 10 percent, while the volume percent of molecular hydrogen is accordingly about 90 percent. As such, the formation of atomic hydrogen is not sufficiently feasible at temperatures of less than 2000° C. At temperatures from 2000° C. to 2800° C., the formation of atomic hydrogen is feasible, but in undesirably small amounts. The results summarized in Table 3 indicate that temperatures equal to or greater than 3000° C. are required for the favorable formation of atomic hydrogen. While not shown in Table 3, at temperatures in excess of 4000° C., the equilibrium of equation (III) is shifted substantially to the right (i.e., substantially all of the molecular hydrogen is converted into atomic hydrogen).

The formation of ionic hydrogen is represented by the following general equation (IV), $$H_{2(g)} \rightleftharpoons 2H^{+}_{(g)} \tag{IV}$$

Gibbs energy minimization computer analysis of the reaction of equation (III) was performed using the HSC Chemistry 5.1 software, and the results thereof are summarized in the following Table 4.

TABLE 4

| T (° C.) | ΔH kcal | ΔS cal/K | ΔG kcal | K | Log (K) |
|---|---|---|---|---|---|
| 1000 | 744.03 | 66.45 | 659.429 | 6.20E−114 | −113.208 |
| 1200 | 746.017 | 67.899 | 645.991 | 1.43E−96 | −95.8447 |
| 1400 | 748.004 | 69.164 | 632.282 | 2.53E−83 | −82.5969 |
| 1600 | 749.991 | 70.286 | 618.335 | 7.08E−73 | −72.15 |
| 1800 | 751.978 | 71.294 | 604.175 | 2.01E−64 | −63.6968 |
| 2000 | 753.966 | 72.209 | 589.823 | 1.94E−57 | −56.7122 |
| 2200 | 755.953 | 73.047 | 575.296 | 1.44E−51 | −50.8416 |
| 2400 | 757.94 | 73.82 | 560.609 | 1.45E−46 | −45.8386 |
| 2600 | 759.927 | 74.537 | 545.772 | 3.03E−42 | −41.5186 |
| 2800 | 761.914 | 75.205 | 530.797 | 1.77E−38 | −37.752 |
| 3000 | 763.902 | 75.832 | 515.693 | 3.67E−35 | −34.4353 |
| 3200 | 765.889 | 76.421 | 500.467 | 3.20E−32 | −31.4949 |
| 3400 | 767.876 | 76.977 | 485.127 | 1.36E−29 | −28.8665 |
| 3600 | 769.863 | 77.504 | 469.678 | 3.13E−27 | −26.5045 |

The results of Table 4 clearly show that the formation of ionic hydrogen over a temperature range of 1000° C. to 3600° C. is not thermodynamically favorable, as the standard Gibbs free energy values are positive and of large magnitude over the entire temperature range. Though not depicted in Table 4, ionic hydrogen is not formed in significant amounts below a temperature of approximately 10,000° C.

The thermodynamic analysis of reaction equations (I) through (IV) as summarized in Tables 1 through 4, provides divergent indications as to the temperatures under which tantalum pentoxide will be adequately reduced by atomic hydrogen to form tantalum metal. In particular, the thermodynamic analysis of reaction equation (II) as summarized in Table 2, indicates that the reduction of tantalum pentoxide by atomic hydrogen is thermodynamically favorable at temperatures of less than or equal to 2600° C. However, the thermodynamic analysis of reaction equation (III) as summarized in Table 3, indicates that temperatures of greater than or equal to 3000° C. are required to form sufficient amounts of atomic hydrogen. As such, taking equations (II) and (III), and the thermodynamic data of Tables 2 and 3 together, the reduction of tantalum pentoxide by a stoichiometric amount of atomic hydrogen (i.e., at a weight ratio of hydrogen gas to tantalum pentoxide of 0.02 to 1.0) does not appear to be reasonably feasible at temperatures of less than 3000° C.

It has been discovered that this barrier, relative to the thermodynamically unfavorable formation of atomic hydrogen at temperatures of less than 3000° C., can be overcome by carefully selecting both: (i) the temperature range at which the hydrogen gas (i.e., molecular hydrogen gas) is heated; and (ii) the weight ratio of hydrogen gas to refractory metal oxide. For purposes of demonstration, the selection of these conditions will be discussed relative to the reduction of tantalum pentoxide ($Ta_2O_5$) to form primary tantalum metal (Ta).

In the following discussion, temperature ranges of about 1900 K to 3600 K or about 2100 K to 3600 K were investigated. The following nine mass (or weight) ratios of hydrogen gas to tantalum pentoxide were investigated over this temperature range: 0.1:1.0; 0.25:1.0; 0.4:1.0; 0.7:1.0; 1:1.0; 1.5:1.0; 2.3:1.0; 4:1.0; and 9:1.0. The recited weight ratios were analyzed by means of a Gibbs energy minimization method, using a computer program that is commercially available from B.G. Trusov, of Moscow, Russia, under the name TERRA. The TERRA computer analysis generated plots of equilibrium mass fractions of the various reaction components and products, relative to a reaction system including tantalum pentoxide and hydrogen gas as reactants, as a function of temperature. In addition, the equilibrium mass fractions of the following co-products are also shown in the graphs: tantalum dioxide ($TaO_{2(g)}$); and tantalum monoxide ($TaO_{(g)}$), which result from the thermal decomposition of tantalum pentoxide, as represented by the following reaction equation (V).

$$Ta_2O_5 \rightleftharpoons TaO_{(g)} + TaO_{2(g)} + O_{2(g)} \tag{V}$$

The graphical plots of mass fraction versus temperature, for the reduction of tantalum pentoxide, are shown in FIGS. 1 through 9 of the drawings. In the graphs of FIGS. 1 through 9, the formulas $Ta_2O_5$(c) and Ta(c) refer to the related condensed species. In FIGS. 1 through 9, the symbol "H" refers to gaseous atomic hydrogen. In FIGS. 1 through 9, all species without a subscript-(c) are gaseous species. Also in FIGS. 1 through 9, there is included a tabulation of the equilibrium mass fraction of primary tantalum metal over a temperature range of 2100 K to 3200 K, at a total pressure of 0.1 MPa.

At a mass (or weight) ratio of hydrogen gas to tantalum pentoxide of 0.1:1.0, the formation of primary tantalum metal is relatively low (having a maximum mass fraction value of 0.049 at a temperature of 2900 K). See the graph and table of FIG. 1. In addition, at 2900 K, the amount of gaseous tantalum dioxide ($TaO_2$) formed is undesirably substantially equivalent to the maximum amount of primary tantalum metal formed at that temperature. As will be discussed further herein, the formation of suboxides of the feed refractory metal oxide (e.g., gaseous TaO and $TaO_2$ in the case of tantalum pentoxide) is typically undesirable, particularly if the suboxides are not reduced by atomic hydrogen.

The level of primary tantalum formed at a mass ratio of hydrogen gas to tantalum pentoxide of 0.25:1.0, is greater relative to a mass ratio of 0.1:1.0 (e.g., having a maximum mass fraction of 0.097 at a temperature of 2900 K). See the graph and table of FIG. 2. However, at a temperature of 2900

K, the amount of gaseous tantalum dioxide formed is undesirably substantially equivalent to the maximum amount of primary tantalum metal formed at that temperature.

Mass ratios of hydrogen gas to tantalum pentoxide of 0.4:1.0, 0.7:1.0, 1.0:1.0 and 1.5:1.0 result in the formation of higher levels of primary tantalum metal, relative to a mass ratio of 0.1:1.0. See FIGS. 3 through 6. However, as similarly observed with a mass ratio of 0.25:1, the level of gaseous suboxide formation (e.g., gaseous TaO and/or $TaO_2$) is undesirably high relative to the level of primary tantalum metal formation at these mass ratios. In addition, at these weight ratios, maximum or peak amounts of primary tantalum metal are formed over relatively narrow temperature ranges (e.g., over a temperature range of 100 K in the case of a mass ratio of 1.5:1.0, see FIG. 6). Maintaining such narrow temperature ranges, while possible under laboratory conditions, may be less than desirable at the plant production level.

A weight ratio of hydrogen gas to refractory metal oxide that provides a balance of a sufficient, reproducible and substantially constant level of primary refractory metal formation over a wide temperature range, is desirable. It is further desirable that the formation of gaseous suboxides of the refractory metal oxide feed material (e.g., gaseous TaO and $TaO_2$) be minimal over this temperature range, in particular if they are not reduced by atomic hydrogen. Such a balance of reaction conditions is particularly desirable at the plant (or commercial) production level, e.g., for purposes of optimizing equipment design and mass balances associated therewith.

Figure 7:
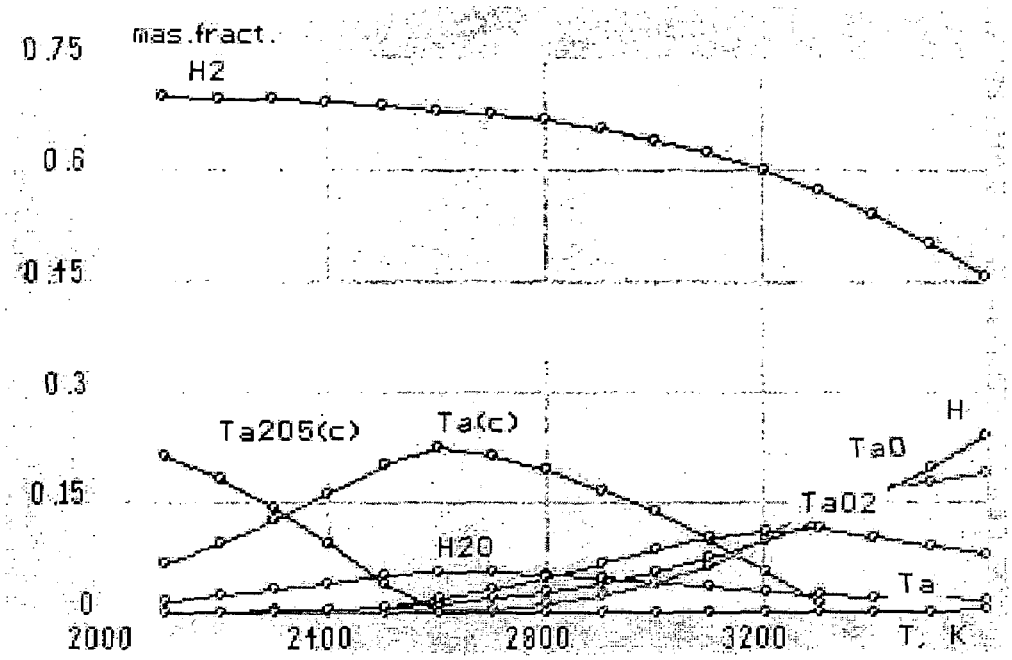
FIG. 7 is a graphical representation of a plot of mass fraction as a function of temperature, for the formation of primary tantalum metal, at a mass ratio of hydrogen gas to tantalum pentoxide of 2.3:1.0, FIG. 7 also includes a tabulation of the mass fraction of condensed primary tantalum metal ($Ta_{(c)}$) as a function of temperature, from which a portion of the graph is drawn.
Figure 8:
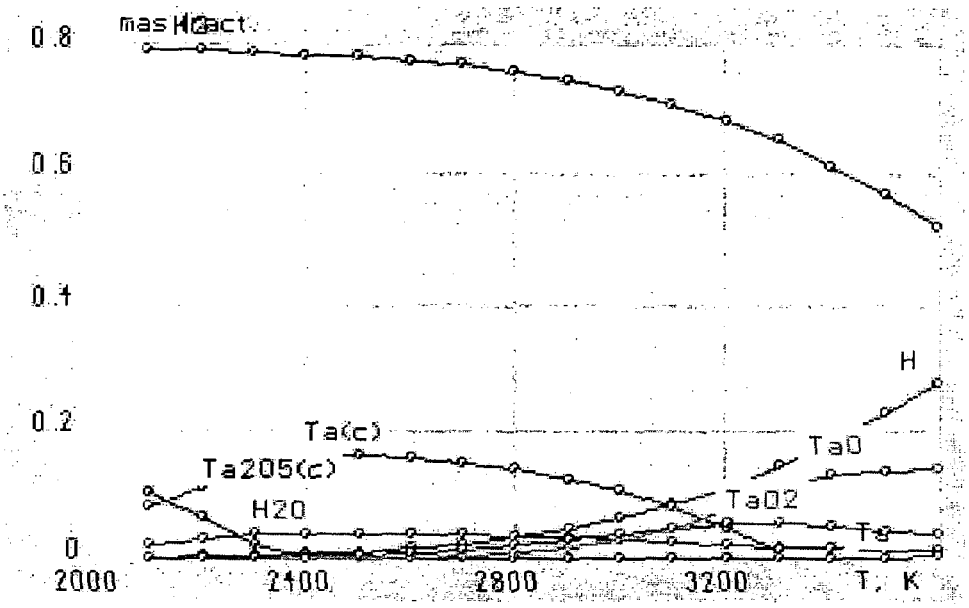
FIG. 8 is a graphical representation of a plot of mass fraction as a function of temperature, for the formation of primary tantalum metal, at a mass ratio of hydrogen gas to tantalum pentoxide of 4.0:1.0, FIG. 8 also includes a tabulation of the mass fraction of condensed primary tantalum metal ($Ta_{(c)}$) as a function of temperature, from which a portion of the graph is drawn.

Such a favorable balance of reaction conditions (i.e., sufficiently high primary tantalum metal formation, coupled with a sufficiently broad temperature range and reduced or minimal level of gaseous suboxide formation) is provided by a mass ratio of hydrogen gas to tantalum pentoxide that is in excess of 1.5:1.0. In an embodiment of the present invention, the mass ratio of hydrogen gas to tantalum pentoxide is preferably at least 2.3:1.0, and more preferably at least 4.0:1.0. See FIGS. 7 and 8. At a mass ratio of hydrogen gas to tantalum pentoxide of 2.3:1.0, a combination of a high level of primary tantalum metal formation and reduced formation of gaseous suboxides (gaseous TaO and $TaO_2$) is achieved over a temperature range of about 2200 K to 2800 K (FIG. 7). A weight ratio of hydrogen gas to tantalum pentoxide of 4.0:1.0 provides a wider temperature range over which a combination of primary tantalum formation is coupled with reduced levels of gaseous suboxide formation, e.g., over a temperature range of about 2100 K to about 2900 K (FIG. 8).

A particularly desirable balance of sufficient, reproducible and substantially constant level of primary tantalum metal formation over a wide temperature range, is provided by a mass ratio of hydrogen gas to tantalum pentoxide of at least 9.0:1.0. See FIG. 9. At a mass ratio of 9.0:1.0, a sufficient and substantially constant level of primary tantalum metal formation (an equilibrium mass fraction value of about 0.08) is achieved over a temperature range of approximately 1900 K to 2700 K. In addition, the formation of gaseous suboxides (gaseous TaO and $TaO_2$) over this temperature range (of 1900 K to 2700 K) is further reduced and minimized.

The reduction of tantalum pentoxide with atomic hydrogen may also be evaluated in terms of tantalum yield. Tantalum yield is calculated from the following equation.

$$\%\ \text{Tantalum yield} = \{Ta_{(c)}/Ta_{(feed)}\} \times 100$$

Figure 10:
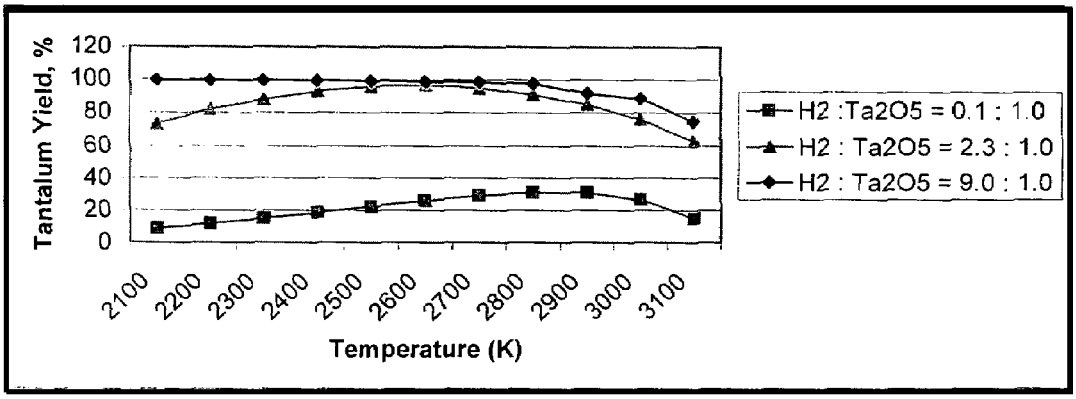
FIG. 10 is a graphical representation of percent tantalum yield as a function of temperature, for three separate weight ratios of hydrogen gas to tantalum pentoxide.

The term "Ta(c)" represents the amount of condensed tantalum metal formed, and the term "Ta(feed)" represents the amount of tantalum fed into the reaction, which is calculated from the weight of tantalum pentoxide ($Ta_2O_5$) fed into the reaction. In FIG. 10, percent tantalum yield as a function of temperature is plotted for hydrogen gas to tantalum pentoxide weight ratios of 9.0:1.0, 2.3:1.0 and 0.1 to 1.0. With reference to FIG. 10, at a weight ratio of hydrogen gas to tantalum pentoxide of 9.0:1.0, a tantalum yield of substantially 100 percent is achieved over a desirably wide temperature range of approximately 2150 K to 2750 K. Based on the increase in both percent tantalum yield and temperature range over which such increased yields are achieved, with increasing weight ratios of hydrogen gas to tantalum pentoxide (as depicted in FIG. 10), it is expected that weight ratios of hydrogen gas to tantalum pentoxide in excess of 9.0:1.0 will likely result in tantalum yields of substantially 100 percent over an even broader temperature range (e.g., over a temperature range of 2000° C. to 3000° C.).

The temperature range of heated gas (which includes hydrogen gas) and the weight ratio of hydrogen gas to refractory metal oxide are also each selected such that the refractory metal oxide feed material is substantially thermodynamically stabilized. In the method of the present invention, thermodynamically stabilizing the refractory metal oxide feed material minimizes the formation of related refractory metal suboxides therefrom, that may not be reduced by contact with atomic hydrogen. Such stabilization, thus better ensures that a more complete reduction of the refractory metal oxide feed material is achieved in the method of the present invention.

For example, the thermal decomposition of tantalum pentoxide results in the formation of gaseous mono- and dioxides as represented by reaction formula (V), which is reproduced as follows.

$$Ta_2O_5 \rightleftharpoons TaO_{(g)} + TaO_{2(g)} + O_{2(g)} \qquad \text{(V)}$$

An equilibrium equation for reaction formula (V) is represented by the following Equation-(1), $$K_{(V)} = P_{TaO2(g)} * P_{TaO(g)} * P_{O2(g)} \qquad (1)$$

In Equation-(1), $K_{(V)}$ is the equilibrium constant for reaction formula (V), and each symbol "P" refers to the related partial pressure.

The following reaction formula (VI) is also of significance, with regard to an analysis of the thermodynamic stability of tantalum pentoxide feed material.

$$H_2O_{(g)} \rightleftharpoons H_{2(g)} + 0.5\ O_{2(g)} \qquad \text{(VI)}$$

An equilibrium equation for reaction formula (VI) is represented by the following Equation-(2), $$K_{(VI)} = \{P_{H2(g)} * (P_{O2(g)})^{0.5}\} / P_{H2O(g)} \qquad (2)$$

In Equation-(2), $K_{(VI)}$ is the equilibrium constant for reaction formula (VI), and each symbol "P" refers to the related partial pressure.

When tantalum pentoxide is heated in the presence of hydrogen gas (see formula (II) above), the partial pressure of oxygen must satisfy both reaction Equations-(1) and -(2). At a given temperature, the equilibrium constants $K_{(v)}$ and $K_{(VI)}$ of Equations-(1) and -(2) each remain constant. As the ratio of $\{P_{H2(g)}/P_{H2O(g)}\}$ of Equation-(2) decreases, the partial pressure of $O_{2(g)}$ of Equation-(2) increases, and accordingly the partial pressure of $O_{2(g)}$ of Equation-(1) also increases. As the partial pressure of $O_{2(g)}$ of Equation-(1) increases, the multiple of the partial pressures of $TaO_{(g)}$ and $TaO_{2(g)}$ decreases. Correspondingly, as the multiple of the partial pressures of $TaO_{(g)}$ and $TaO_{2(g)}$ decreases, the thermodynamic or thermal stability of $Ta_2O_5$ increases, and in particular the volatilization of $Ta_2O_5$ is minimized.

Figure 6:
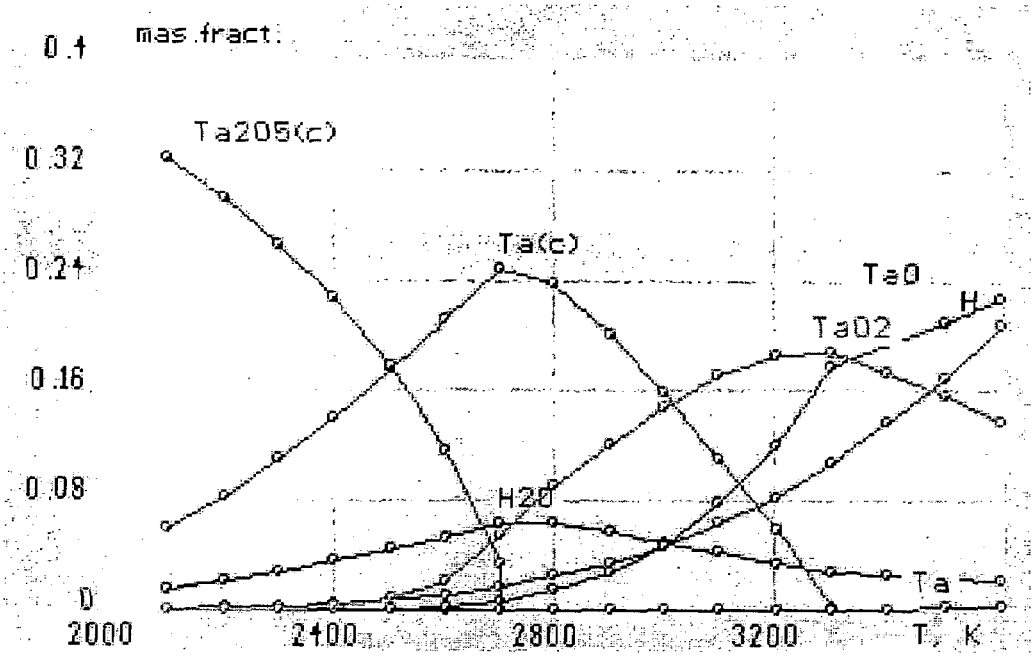
FIG. 6 is a graphical representation of a plot of mass fraction as a function of temperature, for the formation of primary tantalum metal, at a mass ratio of hydrogen gas to tantalum pentoxide of 1.5:1.0, FIG. 6 also includes a tabulation of the mass fraction of condensed primary tantalum metal ($Ta_{(c)}$) as a function of temperature, from which a portion of the graph is drawn.
Figure 9:
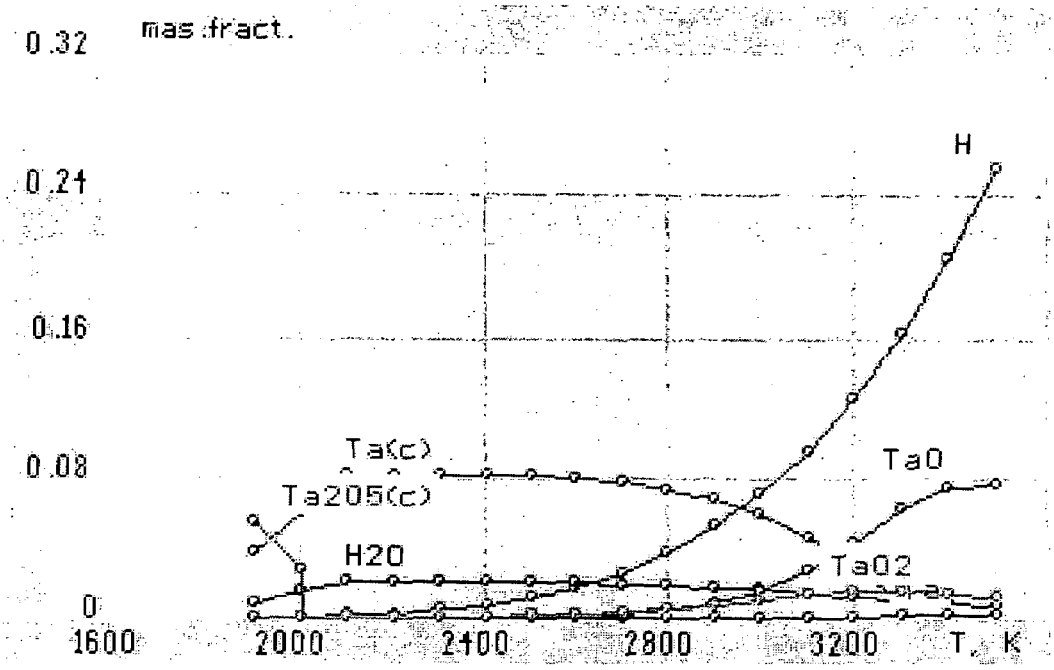
FIG. 9 is a graphical representation of a plot of mass fraction as a function of temperature, for the formation of primary tantalum metal, at a mass ratio of hydrogen gas to tantalum pentoxide of 9.0:1.0, FIG. 9 also includes a tabulation of the mass fraction of condensed primary tantalum metal ($Ta_{(c)}$) as a function of temperature, from which a portion of the graph is drawn.

The effect of the weight ratio of hydrogen gas to tantalum pentoxide on the thermodynamic stabilization of tantalum pentoxide feed material at a particular temperature can be demonstrated with reference to FIGS. 6 and 9 of the drawings. At a weight ratio of hydrogen gas to tantalum pentoxide of 1.5:1.0 and temperature of 2700 K, with reference to FIG. 6, the mass fraction of $TaO_{2(g)}$ is approximately 0.06. However, at a weight ratio of hydrogen gas to tantalum pentoxide of 9.0:1.0 and a temperature of 2700 K, with reference to FIG. 9, the mass fraction of $TaO_{2(g)}$ is negligible (being less than 0.01). As the weight ratio of hydrogen gas to tantalum pentoxide increases, the mass fraction of $TaO_{2(g)}$ decreases, and accordingly the thermodynamic stability of tantalum pentoxide increases.

In the method of the present invention, the refractory metal oxide feed material that is reduced, is in the form of particulate refractory metal oxide. The refractory metal oxide particles may have shapes selected from, but not limited to, spherical shapes, elongated spherical shapes, irregular shapes (e.g., having sharp edges), plate-like or flake-like shapes, rod-like shapes, globular shapes and combinations thereof. The average particle size of the particulate refractory metal oxide is selected such that the particulate refractory metal oxide is free flowing. The particulate refractory metal oxide typically has an average particle size of from 20 μm to 1000 μm, more typically from 30 μm to 800 μm, and further typically from 50 μm to 300 μm.

The primary refractory metal formed in the method of the present invention may be in the form of a substantially solid and continuous material (e.g., in the form of a cylinder). Preferably, the primary refractory metal formed in the method of the present invention is in the form of particulate primary refractory metal, and further preferably is a free flowing particulate primary refractory metal. The particulate primary refractory metal product typically has an average particle size of from 200 nm to 1000 μm, more typically from 1 μm to 800 μm, and further typically from 10 μm to 300 μm.

In the method of the present invention, at least some of the particulate refractory metal oxide is reduced to form primary refractory metal by contact with the heated gas. Preferably, at least 50 percent by weight of the particulate refractory metal oxide, based on the weight of particulate refractory metal oxide, is reduced by contact with the heated gas. In a particularly preferred embodiment of the present invention, at least 90 percent by weight (e.g., 98 or 100 percent by weight) of the particulate refractory metal, based on the weight of particulate refractory metal oxide, is reduced by contact with the heated gas.

The gas, or feed gas (which includes hydrogen gas) is heated in the method of the present invention such that the heated gas includes atomic hydrogen, as discussed previously herein. Preferably the heated gas is substantially free of ionic hydrogen. As used herein and in the claims, the term "substantially free of ionic hydrogen" means the heated gas contains a mass fraction of ionic hydrogen ($H^+_{(g)}$) of less than $1\times10^{-10}$ (as determined by a Gibbs energy minimization calculation using the TERRA computer program).

The refractory metal of the refractory metal oxide may be selected from tantalum (Ta), niobium (Nb), titanium (Ti), zirconium (Zr), hafnium (Hf) and combinations and alloys thereof. Preferably, the refractory metal oxide is selected from tantalum pentoxide, niobium pentoxide, niobium dioxide and combinations thereof.

The heated gas and the particulate refractory metal oxide may be contacted together by suitable means. For example, the particulate refractory metal oxide may be introduced into a stream of the heated gas, or the heated gas may be passed through/over the particulate refractory metal oxide.

In an embodiment, the particulate refractory metal oxide is placed in a suitable container (e.g., a container fabricated from a refractory metal, such as tantalum, niobium or molybdenum) and the heated gas is passed through (and over) the particulate refractory metal oxide within the container. For example, a cylindrical container, having a substantially open end and a terminal end having a fine metal mesh covering there-over, may be used. The particulate refractory metal oxide is placed into the cylindrical container, and the heated gas is introduced continuously into the container through the open end, while gaseous co-products are removed from the container through the fine metal mesh. The primary refractory metal formed within the container may be in a solid continuous form, or preferably in particulate form. The product primary refractory metal may then be removed from the container and further processed (e.g., ground, compacted or fabricated into wire, sheet or foils).

Contact between the refractory metal oxide and the heated gas comprising hydrogen gas may be conducted in the presence of a catalyst. As used herein and in the claims, the term "catalyst," with regard to contact between the refractory metal oxide and the heated gas, means a material that increases the rate of atomic hydrogen formation from hydrogen gas (i.e., molecular hydrogen gas). While not intending to be bound by any theory, it is believed that the catalyst increases the rate of formation of atomic hydrogen from hydrogen gas by lowering the activation energy associated with such formation. The presence of a catalyst is desirable in that a reduction in the temperature required for formation of atomic hydrogen and reduction of the refractory metal oxide may also be achieved (e.g., temperatures of less than or equal to 2000° C., 1500° C. or 1000° C.).

The catalyst is preferably a particulate catalyst comprising a metal selected from at least one of palladium, platinum, iridium, ruthenium, rhodium, combinations thereof, and alloys thereof. Particulate catalysts are preferred due to the higher surface area provided thereby. Typically, the particulate catalyst has a surface area of from 5 to 25 $m^2$/gram of catalyst, e.g., 10 $m^2$/gram of catalyst.

The catalyst, preferably in particulate form, may be placed in a bed through which the heated gas comprising hydrogen gas is passed, thereby forming a stream of gas comprising atomic hydrogen which is then contacted with the refractory metal oxide. In an embodiment, the particulate refractory metal oxide is placed on the upper surface of a screen (e.g., a tantalum screen) having a plurality of perforations therein. The particulate catalyst is held in contact with the lower surface of the screen (e.g., by means of a further screen having a plurality of perforations, the particulate catalyst being interposed between the screen and the further screen). Heated gas comprising hydrogen gas (e.g., heated by means of an electrical resistance furnace) is passed up through the particulate catalyst, thereby forming atomic hydrogen which passes through the screen and contacts the particulate refractory metal oxide residing on the upper surface of the screen, thereby reducing the refractory metal oxide and forming primary refractory metal oxide. Such a screen process is typically conducted as a batch process.

Catalysts may be employed in a continuous process according to the present invention. A screen (e.g., of tantalum) comprising a plurality of perforations is provided in the form of a continuous belt. The belt has an inner surface which defines an inner volume into which the particulate catalyst is introduced and contained. Particulate refractory metal oxide is continuously provided on the outer surface of the upper belt as the belt is continuously moved (e.g., on rollers). At the same time, heated gas comprising hydrogen gas is passed up through the lower portion of the belt and through the particulate catalyst contained within the inner volume of the belt, thereby forming atomic hydrogen. The atomic hydrogen passes further up through the upper portion of the belt and contacts the particulate refractory metal oxide residing on the outer surface of the upper belt, thereby forming primary refractory metal oxide. The belt may optionally be contained in a furnace into which hydrogen gas is introduced.

In an embodiment of the present invention, the heated gas is a plasma. The plasma is formed from a feed gas that comprises an inert gas and the reactive gas. More particularly, the plasma is created by the ionization of the inert gas (e.g., ionized argon), which is distributed throughout and mixed with the hydrogen gas. As used herein and in the claims, the term "plasma" means a heated gas that includes inert gas, inert gas ions and reactive gas (e.g., hydrogen gas and atomic hydrogen), and optionally a small amount of hydrogen ion (e.g., a mass fraction of hydrogen of ion of less than $1\times10^{-10}$). The particulate refractory metal oxide is contacted with the plasma and reduced to form primary refractory metal.

The inert gas and the reactive gas of the plasma, and relative amounts thereof, are each as described previously herein with regard to the gas that is heated in the method of the present invention. For example the inert gas may be selected from at least one group VIII noble gas (e.g., neon, argon, krypton, xenon and combinations thereof).

The reactive gas of the plasma comprises hydrogen and optionally a further reactive gas that is other than hydrogen, such as an alkane (e.g., methane, ethane, propane, butane and combinations thereof). The relative amounts of hydrogen and further reactive gas may be selected from those amounts and ranges as recited previously herein with regard to the gas that is heated in the method of the present invention. Preferably, the reactive gas of the plasma comprises 100 percent by weight of hydrogen, based on the total weight of the reactive gas.

The particulate refractory metal oxide and the plasma may be contacted together by passing the plasma through and over particulate refractory metal oxide. For example, the particulate refractory metal oxide may be placed in a container (e.g., a cylindrical container) through which the plasma is passed, as described previously herein with regard to contacting the particulate refractory metal oxide with a heated gas.

Preferably, the particulate refractory metal oxide and the plasma may be contacted together by introducing the particulate refractory metal oxide into the plasma (sometimes referred to as the plasma flame or plasma stream). Plasma apparatuses that may be used in the method of the present invention include those that are known to the skilled artisan. In an embodiment of the present invention, the plasma apparatus includes a plasma gun, a plasma chemical reactor and a product collection apparatus. The plasma chemical reactor (e.g., in the form of an elongated cylinder) has a first end and a second end. The plasma gun is fixed to the first end of the plasma chemical reactor, and the product collection apparatus is connected to the second end of the plasma chemical reactor. The plasma gun and the product collection apparatus are each in gaseous communication with the plasma chemical reactor. The plasma apparatus is preferably oriented vertically with the plasma gun at the upper end and the product collection apparatus at the lower end thereof, which allows for a combination of gas flow and gravity to drive the product primary refractory metal down into the collection apparatus. Alternatively, the plasma apparatus may be oriented horizontally.

The feed gas (e.g., comprising argon and hydrogen gas in a volume ratio of argon to hydrogen of 3:1) is fed into the plasma gun, and a plasma is formed that extends through at least a portion of the plasma chemical reactor. Particulate refractory metal oxide is fed into the plasma chemical reactor and contacts the plasma therein. The particulate refractory metal oxide may be fed into the reactor by means of an inert carrier gas, such as argon. Optionally, additional reactive gas (e.g., hydrogen) may be fed separately into the plasma chemical reactor.

Contact of the particulate refractory metal oxide with the plasma in the plasma chemical reactor, in accordance with the method of the present invention, results in reduction of the particulate refractory metal oxide to form primary refractory metal oxide. Preferably the primary refractory metal formed in the plasma chemical reactor is in particulate form.

The primary refractory metal product passes from the plasma chemical reactor into the product collection apparatus. The product collection apparatus may be selected from those that are known to the skilled artisan. For example, the product collection apparatus may be in the form of an elongated cylinder having a terminal conical collection portion. The product collection apparatus may include ports for the introduction and passage of additional gasses (e.g., carrier gases, such as argon) therein and there-through, to facilitate collection of the primary refractory metal product. In addition, if the primary refractory metal is melted during its formation in the plasma chemical reactor, the introduction of additional inert carrier gasses into the product collection apparatus may also serve to solidify the primary refractory metal into a particulate form.

The product collection apparatus may optionally include analytical instrumentation, such as a mass spectrometer, to monitor (e.g., continuously) the composition of the gasses passing therethrough. In an embodiment, results of real-time analysis of the gasses passing through the product collection apparatus are used to continuously adjust, for example, the composition and feed rates of the feed gas and the particulate refractory metal oxide that are fed into the plasma chemical reactor. The product primary refractory metal may then be removed from the product collection apparatus.

The method of the present invention may be conducted as a batch process or continuously. Passing a heated gas or plasma through a container that is filled at least partially with particulate refractory metal oxide is typically performed as a batch process. Introducing particulate refractory metal oxide into a stream of heated gas or a plasma (e.g., using a plasma apparatus as described previously herein) is typically conducted as a continuous process.

The method of the present invention may be conducted under conditions of reduced pressure, atmospheric pressure or elevated temperature. For example, reduced pressure may be provided in at least a portion of the product collection apparatus of the plasma apparatus. Typically the method of the present invention is conducted under conditions of substantially atmospheric pressure. In particular, contact between the heated gas (or plasma) and the particulate refractory metal oxide is preferably conducted under conditions of atmospheric pressure (e.g., ambient atmospheric pressure).

Conducting the method of the present invention under conditions of at least atmospheric pressure also serves to stabilize the refractory metal oxide (e.g., tantalum pentoxide). With reference to reaction equation (V) and Equation-(1), previously herein, based on Le Chatelier's Principle, the equilibrium of reaction (V) is shifted to the left (tantalum pentoxide side) as the total pressure increases.

In an embodiment of the present invention, the method involves preparing primary tantalum metal from particulate tantalum pentoxide. The formation of primary tantalum metal has been discussed previously herein with reference to FIGS. 1 through 9. The gas that is contacted with the particulate tantalum pentoxide is heated to a temperature of 1900 K to 2900 K.

The hydrogen gas of the heated gas and the particulate tantalum pentoxide contacted with the heated gas have a mass ratio of hydrogen gas to particulate tantalum pentoxide of greater than 1.5:1. Preferably the mass ratio of hydrogen gas to particulate tantalum pentoxide is greater than or equal to 2.3:1. More preferably the mass ratio of hydrogen gas to particulate tantalum pentoxide is greater than or equal to 4.0:1. In a particularly preferred embodiment, the mass ratio of hydrogen gas to particulate tantalum pentoxide is greater than or equal to 9.0:1. The upper range of the mass ratio of hydrogen gas to particulate tantalum pentoxide is typically less than or equal 15:1, more typically less than or equal to 11:1, and further typically less than or equal to 10:1. The mass ratio of hydrogen gas to particulate tantalum pentoxide may range between any combination of these upper and lower values, inclusive of the is recited values (unless otherwise stated). For example, the mass ratio of hydrogen gas to particulate tantalum pentoxide may range from a value greater than 1.5:1 to 15:1, preferably from 2.3:1 to 10:1, more preferably from 4.0:1 to 10:1, and still more preferably from 9:1 to 15:1, or 9:1 to 11:1, or 9:1 to 10:1.

When the mass ratio of hydrogen gas to particulate tantalum pentoxide range is greater than or equal to 9:1, the particulate tantalum pentoxide is preferably contacted with the heated gas at a temperature of 1900 K to 2700 K.

The primary tantalum metal may be prepared by contacting particulate tantalum pentoxide with a plasma, in accordance with the method described previously herein.

The particulate tantalum pentoxide may be selected from commercially available grades. To improve the purity of the product primary tantalum metal, it is preferable to use a particulate tantalum pentoxide that is substantially pure. In an embodiment of the present invention, the particulate tantalum pentoxide is substantially pure. Substantially pure tantalum pentoxide typically contains carbon, niobium, silicon, tungsten, aluminum and iron in a total amount of less than 50 ppm. In a particularly preferred embodiment of the present invention, the substantially pure particulate tantalum pentoxide has a carbon content of less than 10 ppm.

In an embodiment of the present invention, primary niobium metal is prepared from niobium pentoxide ($Nb_2O_5$) and/or niobium dioxide ($NbO_2$). Weight ratios of hydrogen gas to niobium pentoxide were investigated at temperatures from 2000 K to 3800 K, by means of a Gibbs energy minimization method, using a computer program that is commercially available from B.G. Trusov, of Moscow, Russia, under the name TERRA. The following mass ratios of hydrogen gas to niobium pentoxide were investigated: 2.3:1.0, 4.0:1.0 and 9.0:1.0. See FIGS. 11, 12 and 13.

Figure 11:
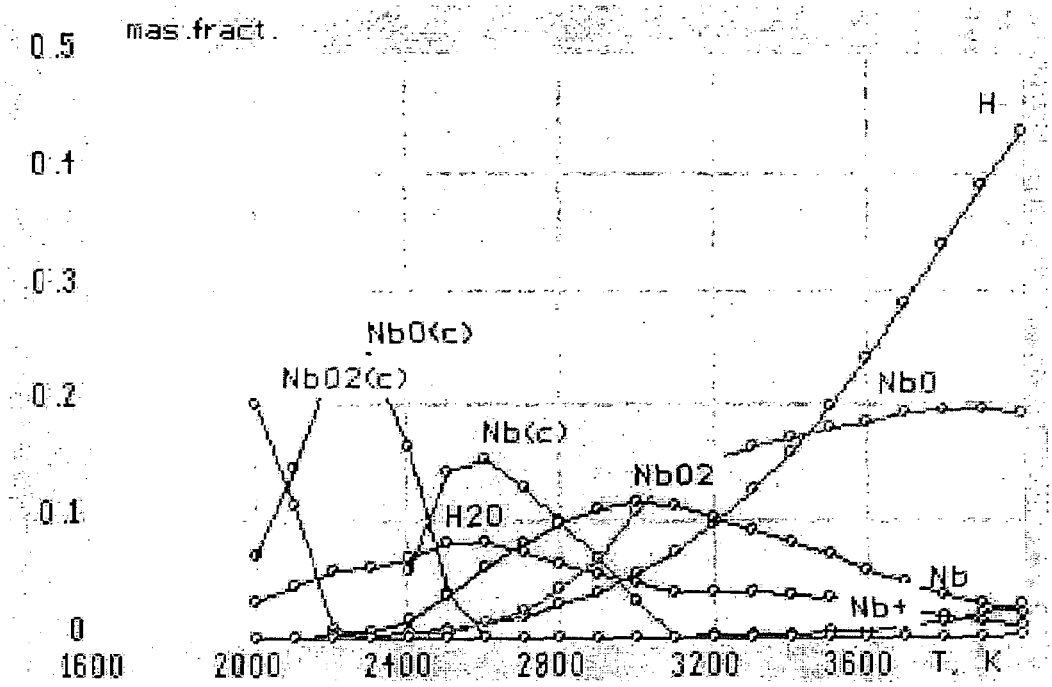
FIG. 11 is a graphical representation of a plot of mass fraction as a function of temperature, for the formation of primary niobium metal, at a mass ratio of hydrogen gas to niobium pentoxide of 2.3:1.0, FIG. 11 also includes a tabulation of the mass fraction of condensed primary tantalum metal ($Nb_{(c)}$) as a function of temperature, from which a portion of the graph is drawn.
Figure 12:
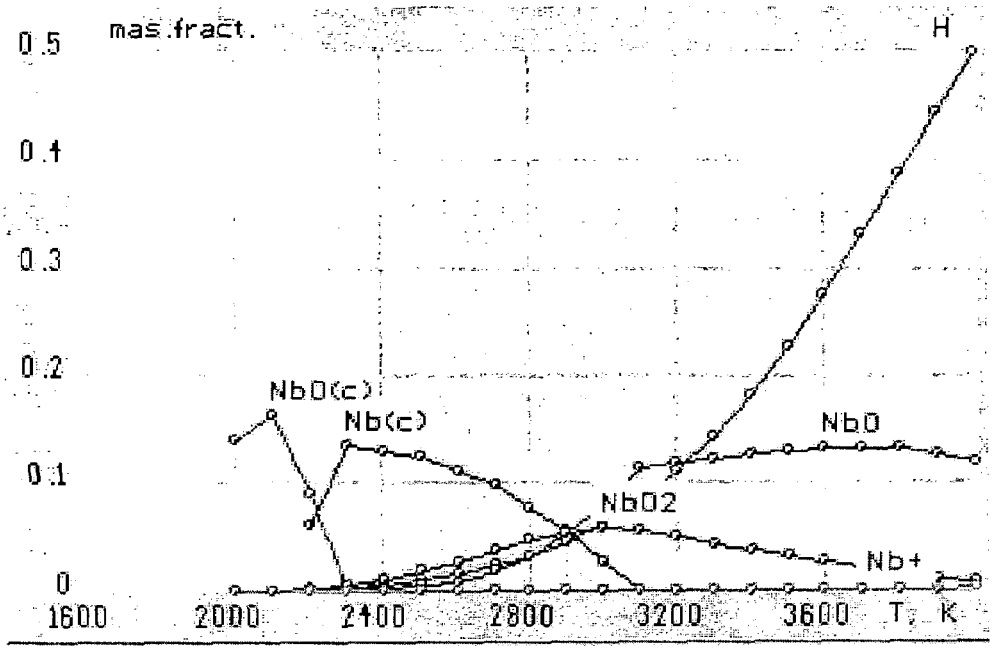
FIG. 12 is a graphical representation of a plot of mass fraction as a function of temperature, for the formation of primary niobium metal, at a mass ratio of hydrogen gas to niobium pentoxide of 4.0:1.0, FIG. 12 also includes a tabulation of the mass fraction of condensed primary tantalum metal ($Nb_{(c)}$) as a function of temperature, from which a portion of the graph is drawn.
Figure 13:
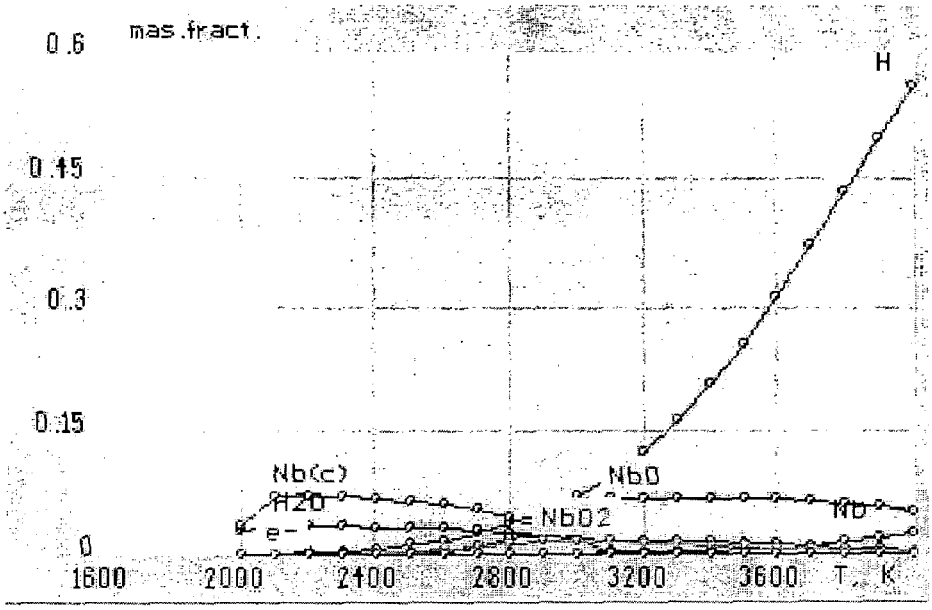
FIG. 13 is a graphical representation of a plot of mass fraction as a function of temperature, for the formation of primary niobium metal, at a mass ratio of hydrogen gas to niobium pentoxide of 9.0:1.0, FIG. 13 also includes a tabulation of the mass fraction of condensed primary tantalum metal ($Nb_{(c)}$) as a function of temperature, from which a portion of the graph is drawn.

FIGS. 11 through 13 also include a tabulation of the mass fraction of primary niobium metal formed as a function of temperature, from which a portion of each graph is drawn. In FIGS. 11 through 13, the parenthetical symbol "(c)" identifies a condensed species (e.g., $Nb_{(c)}$ means condensed niobium). In addition, in FIGS. 11 through 13, all species not having a subscript-(c) are gaseous species.

In accordance with the method of the present invention it is preferable to reduce substantially all of the niobium pentoxide and/or niobium dioxide to form primary niobium metal. However, the co-product formation of niobium monoxide may also be desirable, as combinations of primary niobium metal and niobium monoxide are commercially useful.

At a mass ratio of hydrogen gas to niobium pentoxide of 2.3:1.0, the formation of primary niobium metal peaks over a relatively narrow temperature range (between 2600 K and 2700 K). In addition, niobium monoxide is concurrently formed with the primary niobium metal. See FIG. 11.

At a mass ratio of hydrogen gas to niobium pentoxide of 4.0:1.0, the formation of primary niobium metal peaks at a temperature of 2300 K, from which it steadily drops off. Niobium monoxide is concurrently formed at both the lower and upper temperature ranges over which the primary niobium metal is formed under these conditions. At a mass ratio of hydrogen gas to niobium pentoxide of 4.0:1.0, formation of primary niobium metal is preferably performed over a temperature range of 2300 K to 2600 K. See FIG. 12.

A particularly desirable balance of sufficient, reproducible and substantially constant level of primary niobium metal formation over a wide temperature range, is achieved at a weight ratio of hydrogen gas to niobium pentoxide of at least 9.0:1.0. See FIG. 13. At a weight ratio of 9.0:1.0, a sufficient and substantially constant level of primary niobium metal formation (having an equilibrium mass fraction value of about 0.06 to 0.07) is achieved over a temperature range of approximately 2100 K to 2700 K. In addition, the formation of suboxides (NbO in particular) over this temperature range (of 2100 K to 2700 K) is substantially reduced and minimized.

In an embodiment of the present invention, the hydrogen gas of the heated gas and the particulate niobium pentoxide contacted with the heated gas (to form primary niobium metal) have a mass ratio of hydrogen gas to particulate niobium pentoxide of greater than 2.3:1. Preferably the mass ratio of hydrogen gas to particulate niobium pentoxide is greater than or equal to 4.0:1. More preferably the mass ratio of hydrogen gas to particulate niobium pentoxide is greater than or equal to 9.0:1. The upper range of the mass ratio of hydrogen gas to particulate niobium pentoxide is typically less than or equal to 15:1, more typically less than or equal to 11:1, and further typically less than or equal to 10:1. The mass ratio of hydrogen gas to particulate niobium pentoxide may range between any combination of these upper and lower values, inclusive of the recited values (unless otherwise stated). For example, the mass ratio of hydrogen gas to particulate niobium pentoxide may range from a value of greater than 2.3:1 to 15:1, preferably from 4.0:1 to 11:1, and more preferably from 9.0:1 to 15:1, or 9.0:1 to 11:1, or 9.0:1 to 10:1.

Figure 14:
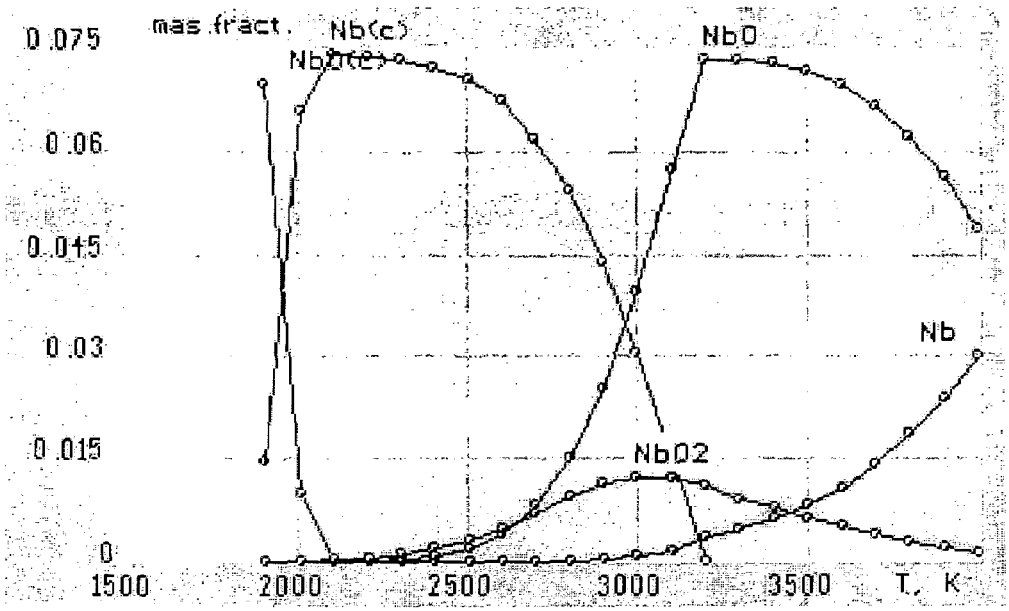
FIG. 14 is a graphical representation of a plot of mass fraction as a function of temperature, for the formation of primary niobium metal, at a mass ratio of hydrogen gas to niobium dioxide of 9.0:1.0, FIG. 14 also includes a tabulation of the mass fraction of condensed primary tantalum metal ($Nb_{(c)}$) as a function of temperature, from which a portion of the graph is drawn.

The formation of primary niobium metal from niobium dioxide ($NbO_2$) was investigated at temperatures from 1900 K to 4000 K, by means of a Gibbs energy minimization method, using a computer program that is commercially available from B.G. Trusov, of Moscow, Russia, under the name TERRA. A weight ratio of hydrogen gas to niobium dioxide of 9.0:1.0 was investigated. See FIG. 14. FIG. 14 also includes a tabulation of the mass fraction of primary niobium metal formed as a function of temperature, from which a portion of the graph is drawn. As with FIGS. 1 through 13, in FIG. 14, the parenthetical symbol "(c)" identifies a condensed species (e.g., $Nb_{(C)}$ means condensed niobium), and species that do not have a subscript-(c) are gaseous species.

At a mass ratio of hydrogen gas to niobium dioxide of 9.0:1.0, the formation of primary niobium metal peaks at a temperature of 2100 K, from which it at first slowly then quickly drops off. See FIG. 14. A particularly desirable balance of sufficient, reproducible and substantially constant level of primary niobium metal formation over a wide temperature range, is achieved at a weight ratio of hydrogen gas to niobium dioxide of at least 9.0:1.0. See FIG. 14. At a weight ratio of 9.0:1.0, a sufficient and substantially constant level of primary niobium metal formation (having an equilibrium mass fraction value of about 0.07) is achieved over a temperature range of approximately 2100 K to 2500 K. In addition, the formation of suboxides (NbO in particular) over this temperature range (of 2100 K to 2500 K) is substantially reduced and minimized.

In the method of the present invention, the upper range of the mass ratio of hydrogen gas to particulate niobium dioxide is typically less than or equal 15:1, more typically less than or equal to 11:1, and further typically less than or equal to 10:1. The mass ratio of hydrogen gas to particulate niobium dioxide may range between any combination of these upper values and a ratio of 9:1, inclusive of the recited values. For example, the mass ratio of hydrogen gas to particulate niobium dioxide may range from a value at least 9.0:1 to 15:1, preferably from 9.0:1 to 11:1, and more preferably from 9.0:1 to 10:1.

The particulate niobium pentoxide and niobium dioxide may each be selected independently from commercially available grades. To improve the purity of the product primary niobium metal, it is preferable to use a particulate niobium pentoxide and/or niobium dioxide that is substantially pure. In an embodiment of the present invention, the particulate oxide of niobium (i.e., niobium pentoxide and/or niobium dioxide) is substantially pure. Substantially pure particulate niobium pentoxide and/or niobium dioxide typically contains carbon, tantalum, iron, silicon, tungsten and aluminum in a total amount of less than 50 ppm. In a particularly preferred embodiment of the present invention, the substantially pure particulate oxide of niobium has a carbon content of less than 10 ppm.

Primary niobium metal may be formed in accordance with the present invention using those methods as discussed previously herein with regard to primary refractory metals in general and primary tantalum metal in particular. For example, the heated gas and the niobium pentoxide and/or niobium dioxide may be contacted together by passing the heated gas (optionally in the form of a plasma) through and over particulate niobium pentoxide while it is held within a container (e.g., a cylindrical container). Alternatively, particulate niobium pentoxide and/or niobium dioxide may be introduced into a plasma comprising hydrogen gas, thereby forming primary niobium metal, as discussed previously herein.

Articles of manufacture that may include the primary refractory metals (e.g., tantalum and/or niobium) prepared in accordance with the method of the present invention include, but are not limited to, electronic capacitors, computer grade solid electrolytes, telecommunications grade solid electrolytes, electro-optical assemblies and superconductive articles. In particular, so called small size capacitors (having a combination of high capacitance per unit volume and stable performance properties) may be fabricated from primary refractory metals prepared in accordance with the method of the present invention. Preferably, the primary refractory metals prepared in accordance with the present invention are particulate primary refractory metals, and the recited articles of manufacture (e.g., electronic capacitors) are fabricated from the particulate primary refractory metals.

The present invention has been described with reference to specific details of particular embodiments thereof. It is not intended that such details be regarded as limitations upon the scope of the invention except insofar as and to the extent that they are included in the accompanying claims.

What is claimed is:

1. A method of preparing a primary refractory metal comprising:

(a) heating a gas comprising a reactive gas, said reactive gas comprising hydrogen gas, thereby forming a heated gas having a temperature range; and (b) contacting a particulate refractory metal oxide with said heated gas, wherein, (i) said temperature range of said heated gas, and (ii) a weight ratio of the hydrogen gas of said heated gas to said particulate refractory metal oxide, are each selected such that, said heated gas comprises atomic hydrogen, said refractory metal oxide is substantially thermodynamically stabilized, and said refractory metal oxide is reduced by atomic hydrogen in step (b), thereby forming said primary refractory metal, and wherein said refractory metal oxide is tantalum pentoxide or niobium pentoxide and has a carbon content of less than 10 ppm.

2. The method of claim 1 wherein at least 90% by weight of said particulate refractory metal oxide is reduced and formed into primary refractory metal in step (b) and said heated gas is substantially free of ionic hydrogen.

3. The method of claim 1 wherein said heated gas is a plasma, said plasma being formed from a feed gas comprising an inert gas and said reactive gas, and said particulate refractory metal being contacted with said plasma in step (b).

4. The method of claim 3 wherein said inert gas is selected from the group consisting of group VIII noble gasses of the periodic table of the elements, and combinations thereof and said particulate refractory metal oxide is contacted with said plasma by introducing said particulate refractory metal oxide into said plasma.

5. The method of claim 1 wherein the reactive gas comprises substantially 100 percent by weight of hydrogen gas and said particulate refractory metal oxide is contacted with said heated gas in the presence of a catalyst.

6. The method of claim 5, wherein said catalyst is a particulate catalyst comprising a metal selected from the group consisting of palladium, platinum, iridium, ruthenium, rhodium, combinations thereof and alloys thereof.

7. A method of preparing primary tantalum metal comprising:

(a) heating a gas comprising a reactive gas, said reactive gas comprising hydrogen gas, thereby forming a heated gas; and (b) contacting particulate tantalum pentoxide with said heated gas at a temperature of 1900 K to 2900 K, thereby reducing said particulate tantalum pentoxide and forming primary tantalum metal;

wherein the hydrogen gas of said heated gas and said particulate tantalum pentoxide contacted with said heated gas have a mass ratio of hydrogen gas to particulate tantalum pentoxide of greater than 1.5:1, and wherein said tantalum pentoxide has a carbon content of less than 10 ppm.

8. The method of claim 7 wherein the reactive gas comprises substantially 100 percent by weight of hydrogen gas and said mass ratio of hydrogen gas to particulate tantalum pentoxide is at least 4:1.

9. The method of claim 7 wherein said mass ratio of hydrogen gas to particulate tantalum pentoxide is at least 9:1, and the particulate tantalum pentoxide is contacted with said heated gas at a temperature of 1900 K to 2700 K.

10. The method of claim 7 wherein at least 98% by weight of said particulate tantalum pentoxide is reduced and formed into particulate primary tantalum metal in step(b).

11. The method of claim 7 wherein said heated gas is a plasma, said plasma being formed from a feed gas comprising an inert gas and said reactive gas, and said particulate tantalum pentoxide being contacted with said plasma in step (b) and said inert gas is selected from the group consisting of group VIII noble gasses of the periodic table of the elements, and combinations thereof.

12. The method of claim 11 wherein said particulate tantalum pentoxide is contacted with said plasma by introducing said particulate tantalum pentoxide into said plasma.

13. The method of claim 7 wherein said tantalum pentoxide is substantially pure tantalum pentoxide.

14. The method of claim 7 wherein said process is conducted at substantially atmospheric pressure.

15. A method of preparing primary niobium metal comprising:

(a) heating a gas comprising a reactive gas, said reactive gas comprising hydrogen gas, thereby forming a heated gas; and (b) contacting a particulate oxide of niobium comprising niobium pentoxide having a carbon content of less than 10 ppm, with said heated gas at a temperature of 2100 K to 2700 K, thereby reducing said particulate oxide of niobium and forming primary niobium metal;

wherein the hydrogen gas of said heated gas and said particulate oxide of niobium contacted with said heated gas have a mass ratio of hydrogen gas to particulate oxide of niobium of at least 9:1.

16. The method of claim 15 wherein at least 90% by weight of said particulate oxide of niobium is reduced and formed into primary niobium metal in step (b).

17. The method of claim 15 wherein the primary niobium metal formed is particulate primary niobium metal.

18. The method of claim 15 wherein said heated gas is a plasma, said plasma being formed from a feed gas comprising an inert gas and said reactive gas, and said particulate oxide of niobium being contacted with said plasma in step (b).

19. The method of claim 18 wherein said inert gas is selected from the is group consisting of group VIII noble gasses of the periodic table of the elements, and combinations thereof.

20. The method of claim 18 wherein said particulate oxide of niobium is contacted with said plasma by introducing said particulate oxide of niobium into said plasma.

21. The method of claim 15 wherein the reactive gas comprises substantially 100 percent by weight of hydrogen gas.

22. The method of claim 15 wherein said process is conducted at substantially atmospheric pressure and said oxide of niobium is substantially pure niobium pentoxide.

* * * * *